US011594393B2

(12) United States Patent
Yamakata

(10) Patent No.: US 11,594,393 B2
(45) Date of Patent: Feb. 28, 2023

(54) X-RAY TUBE, X-RAY ANALYSIS APPARATUS, AND METHOD OF COOLING TARGET IN X-RAY TUBE

(71) Applicant: Rigaku Corporation, Akishima (JP)

(72) Inventor: Masaaki Yamakata, Akishima (JP)

(73) Assignee: RIGAKU CORPORATION, Tokyo (JP)

( * ) Notice: Subject to any disclaimer, the term of this patent is extended or adjusted under 35 U.S.C. 154(b) by 0 days.

(21) Appl. No.: 17/169,956

(22) Filed: Feb. 8, 2021

(65) Prior Publication Data

US 2021/0249214 A1 Aug. 12, 2021

(30) Foreign Application Priority Data

Feb. 7, 2020 (JP) ..... JP2020-020085

(51) Int. Cl.
*H01J 35/12* (2006.01)

(52) U.S. Cl.
CPC ..... *H01J 35/13* (2019.05)

(58) Field of Classification Search
CPC ..... H01J 35/12; H01J 35/13; H01J 2235/127; H01J 2235/1283
See application file for complete search history.

(56) References Cited

U.S. PATENT DOCUMENTS 4,455,504 A * 6/1984 Iversen ..... H01J 35/13 313/30
4,521,903 A * 6/1985 Braun ..... H01J 35/106 378/143
6,580,780 B1 * 6/2003 Miller ..... H01J 35/13 378/141

FOREIGN PATENT DOCUMENTS

JP S5641454 U 4/1981
JP S56041453 U 4/1981
JP 2003036806 A 2/2003

OTHER PUBLICATIONS

JPO Notice of Reasons for Refusal for corresponding JP Application No. 2020-020085; dated Jan. 24, 2023.

* cited by examiner

*Primary Examiner* — Jurie Yun
(74) *Attorney, Agent, or Firm* — Cantor Colburn LLP

(57) ABSTRACT

Provided is an X-ray tube, including: an electron-beam emitting unit; a target having a first surface and a second surface; a solid heat diffusion member fixed onto the second surface of the target; and a flow-path forming member, which is arranged on a side of the solid heat diffusion member, the side being opposite to the target, and that is configured to define a film flow path in which a cooling fluid forms a film flow that is parallel to a surface shape of the solid heat diffusion member. A protruding portion protrudes toward the side of the solid heat diffusion member, which is opposite to the target. The film flow path has a shape extending along at least a part of a surface of the protruding portion.

13 Claims, 18 Drawing Sheets

RELATED ART

RELATED ART

X-RAY TUBE, X-RAY ANALYSIS APPARATUS, AND METHOD OF COOLING TARGET IN X-RAY TUBE

CROSS-REFERENCE TO RELATED APPLICATION

The present invention claims priority under 35 U.S.C. § 119 to Japanese Patent Application No. 2020-020085, filed on Feb. 7, 2020, the entire content of which is incorporated herein by reference.

BACKGROUND OF THE INVENTION

Field of the Invention

The present invention relates to an X-ray tube, an X-ray analysis apparatus, and a method of cooling a target in an X-ray tube.

Description of the Related Art

In Japanese Patent Application Laid-open No. 2003-36806, there is described an X-ray tube device (X-ray tube) including a cooling nozzle and bottom-surface fins. Cooling insulating oil is ejected from the cooling nozzle toward a center of a bottom surface of an anode onto which a target is fixed. The bottom-surface fins are provided on the bottom surface of the anode.

Further, in Microfilm of Japanese Utility Model Application No. S54-122920 (Japanese Utility Model Application Laid-open No. S56-41454), there is described an X-ray tube for diffraction. In the X-ray tube for diffraction, a heat radiation member having a plurality of cooling fins provided in parallel is joined to a back surface of an X-ray radiation member (target) so that pipelines for cooling water are formed along the cooling fins.

As described in Japanese Patent Application Laid-open No. 2003-36806, the following structure is generally used for cooling of a target of an X-ray tube. Specifically, a cooling fluid such as pure water is jetted through a nozzle from a side opposite to a side where an electron beam collides against a target serving as an anode, and is caused to collide against the target.

FIG. 1 is a schematic sectional view for illustrating a typical cooling structure assembly 900 for a target 901. In FIG. 1, the target 901 is fixed onto a support base 902, which also serves as an anode. An electron beam 903 is radiated from a cathode (not shown) arranged above (on an upper side of FIG. 1) the target 901 toward the target 901. An X-ray is radiated as a result of collision between the electron beam 903 and the target 901. At this time, heat is generated by the collision between the electron beam 903 and the target 901.

A nozzle 904 being open toward the support base 902 is arranged below (on a lower side of FIG. 1) the support base 902. A jet 905 of water being a cooling fluid is sprayed to the support base 902 to cool the support base 902 from a back side thereof. Thus, heat generated at a front surface of the target 901 propagates to the support base 902 to be carried away with the sprayed water.

In this case, in order to improve cooling performance, the nozzle 904 is arranged so as to spray the jet 905 directly to a portion that may have the highest temperature. Specifically, the nozzle 904 is arranged below a back side of the support base 902 at such a position as to be able to spray the jet 905 to a position on the support base 902, which is located immediately below a position at which the electron beam 903 collides against the target 901 to generate heat. The electron beam 903 has a sectional shape elongated in a width direction, which conforms to a shape of the cathode. Thus, a heat generating portion of the target 901 also has a shape elongated in the width direction. When a center of the heat generating portion of the target 901 is referred to as "heat generation center", the nozzle 904 is arranged so as to spray the jet 905 toward the heat generation center.

FIG. 2 is a typical example of a graph for showing a flow velocity v of a cooling fluid with respect to a distance r from the heat generation center in the cooling structure assembly 900. As shown in the graph of FIG. 2, the flow velocity v has a large value in a narrow region in the vicinity of the heat generation center. As the distance r from the heat generation center increases, the flow velocity v suddenly decreases. Thus, in most of the region except for the vicinity of the heat generation center, the value of the flow velocity v is limited to be small.

The value of the flow velocity v shows that efficient cooling, specifically, heat transfer to the cooling fluid is achieved only in an extremely narrow region in the vicinity of the heat generation center, and a peripheral region around the heat generation center contributes little to the cooling in the typical cooling structure assembly 900 for a target. Besides, the inventors of the present invention have found out that the cooling structure assembly 900 illustrated in FIG. 1 is disadvantageous not only in the above-mentioned point but also in the following points. Specifically, first, when jet impingement is caused, most of the kinetic energy of the cooling fluid turns into heat through fluid friction and is lost. Second, heat transfer in a turbulent boundary layer formed in the vicinity of a solid surface is dominant in heat transfer from the solid surface to the cooling fluid. Thus, a fluid ("a" in FIG. 1) flowing in the vicinity of the back side of the support base 902 in FIG. 1 contributes to the cooling. However, a fluid ("b" in FIG. 1) flowing in a region farther from the back side of the support base 902 contributes little to the cooling.

Specifically, a considerable part of energy given by a fluid pump to produce the jet 905 of the cooling fluid through the nozzle 904 is lost through the jet impingement or is consumed to form a fluid flow that contributes little to the cooling. This means that the fluid pump having excessively high performance in terms of a flow rate and pressurization is needed for the cooling of the target 901. As a result, reductions in size and energy consumption of an apparatus that uses the X-ray tube, for example, an X-ray analysis apparatus are hindered. Further, it is considered that cost of the apparatus has increased.

From another point of view, a problem also arises in that an X-ray output cannot be increased. Specifically, when intensity of the electron beam 903 is increased so as to increase the X-ray output, a heat generation quantity also increases. In order to prevent melting of the target 901, a fluid pump having higher performance is required to be prepared to increase a flow rate, specifically, a flow velocity of the jet 905 sprayed from the nozzle 904 so as to enhance the cooling performance. However, when a high pressure is applied to the fluid so as to increase the flow velocity of the jet 905, cavitation may occur in the jet 905 and the support base 902 may be significantly damaged by erosion. Thus, there is a limit to pressurization of the fluid, resulting in a limited X-ray output.

SUMMARY OF THE INVENTION

The invention disclosed in the present application has various aspects. Outlines of representative aspects are as follows.

(1) An X-ray tube, including: an electron-beam emitting unit configured to emit an electron beam; a target having a first surface against which the electron beam collides and a second surface on a side opposite to the first surface; a solid heat diffusion member fixed onto the second surface of the target; and a flow-path forming member, which is arranged on a side of the solid heat diffusion member, the side being opposite to the target, and is configured to define a film flow path in which a cooling fluid forms a film flow, wherein a protruding portion protruding toward the side of the solid heat diffusion member, which is opposite to the target, is formed to fall within a region including a heat generation center at which the electron beam collides against the target to generate heat when viewed in a direction of emission of the electron beam, and wherein the film flow path has a shape extending along at least a part of a surface of the protruding portion.

(2) In the X-ray tube according to item (1), the film flow path has such a shape that an average flow velocity of the cooling fluid at a predetermined distance from the heat generation center is larger than an average flow velocity of the cooling fluid at the heat generation center, when viewed in the direction of emission of the electron beam.

(3) In the X-ray tube according to item (1) or (2), the film flow path has such a shape that a flow path sectional area is minimized at a predetermined distance from the heat generation center, when viewed in the direction of emission of the electron beam.

(4) In the X-ray tube according to any one of items (1) to (3), the protruding portion has one of a spherical-head shape and a pointed-head shape.

(5) In the X-ray tube according to any one of items (1) to (4), the X-ray tube further includes an introduction pipe portion, which is configured to introduce the cooling fluid into the film flow path, and is arranged such that a center axis of the introduction pipe portion and a center axis of the protruding portion are aligned.

(6) In the X-ray tube according to any one of items (1) to (3) and (5), the film flow path has an inflow port and an outflow port for the cooling fluid, and has a circular annular shape that surrounds the protruding portion.

(7) In the X-ray tube according to item (6), the inflow port and the outflow port are located on opposite sides of the film flow path with respect to the protruding portion located therebetween.

(8) In the X-ray tube according to item (6) or (7), the film flow path has a separation wall configured to separate different flows of the cooling fluid from each other at a position of the outflow port.

(9) In the X-ray tube according to any one of items (1) to (8), the film flow path has one of an oval shape and an elliptical shape, each having a long axis extending in a longitudinal direction of a heat generating region that generates heat as a result of collision of the electron beam against the target, when viewed in the direction of emission of the electron beam.

(10) In the X-ray tube according to any one of items (1) to (9), the flow-path forming member has rectifier fins arranged along a direction of flow of the cooling fluid.

(11) An X-ray analysis apparatus, including the X-ray tube of any one of items (1) to (10).

(12) A method of cooling a target in an X-ray tube, the method including cooling a target by causing a cooling fluid for cooling the target to flow through a film flow path in which an average flow velocity of the cooling fluid in a peripheral region around a heat generation center at which an electron beam collides against the target to generate heat is larger than an average flow velocity of the cooling fluid at the heat generation center, when viewed in a direction of emission of the electron beam.

DETAILED DESCRIPTION OF THE INVENTION

An X-ray tube 100 according to a first embodiment of the present invention will now be described with reference to FIG. 3 to FIG. 5.

Figure 3:
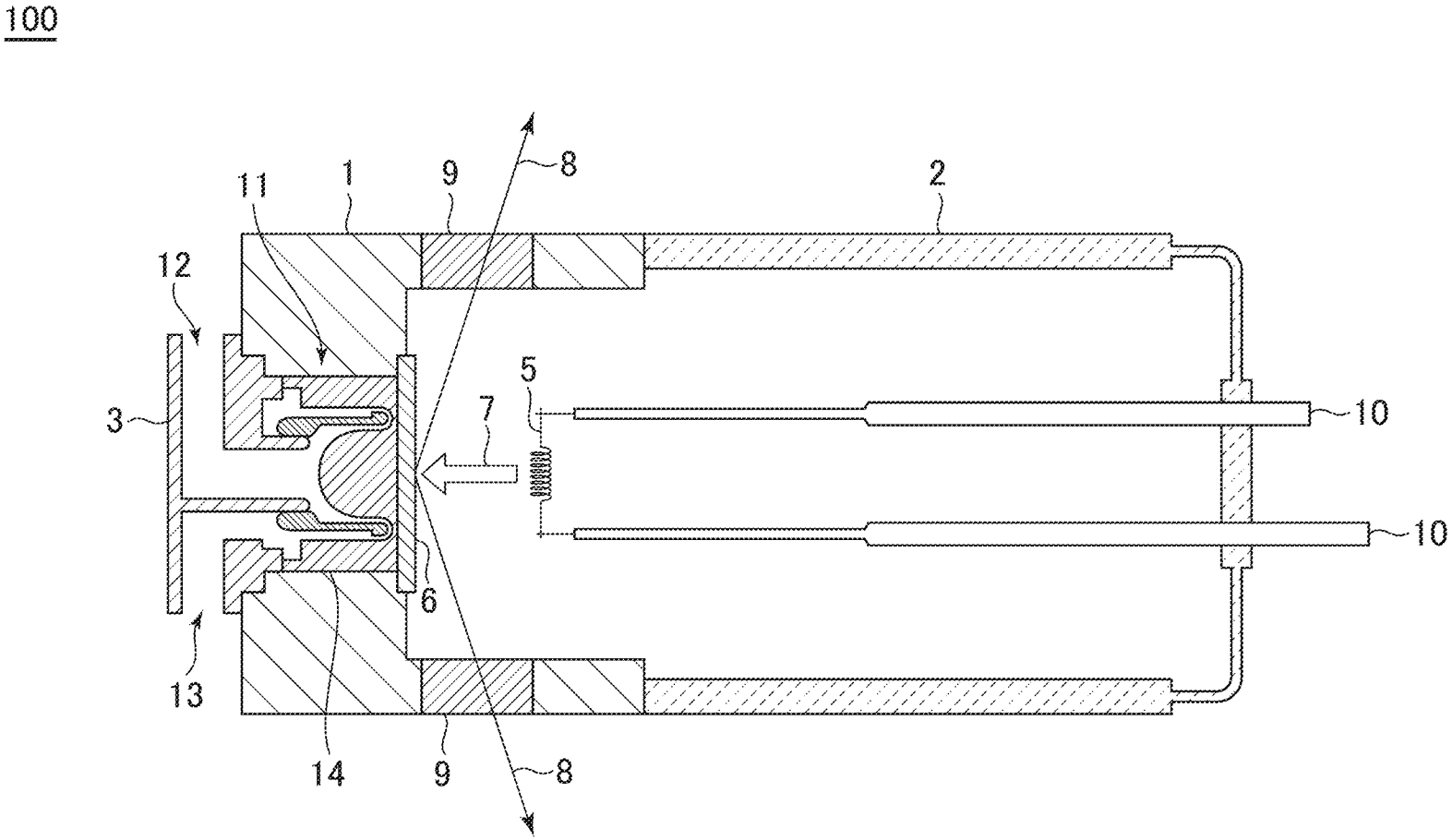
FIG. 3 is a schematic sectional view for illustrating a structure of an X-ray tube according to a first embodiment of the present invention.

FIG. 3 is a schematic sectional view for illustrating a structure of the X-ray tube 100 according to the first embodiment of the present invention. The X-ray tube 100 is a vacuum tube (so-called "thermionic tube") mainly including a base 1 and a housing 2. The base 1 has a substantially cylindrical shape. The housing 2, which is made of a ceramic and has a bottomed cylindrical shape, is mounted on the base 1. An inside of the X-ray tube 100 is kept airtight, and is decompressed into a vacuum state. When the X-ray tube 100 is to be mounted in an apparatus that uses an X-ray, such as an X-ray analysis apparatus, the X-ray tube 100 is mounted on a header 3. The header 3 is prepared on the apparatus side and serves as a mount attachment for the X-ray tube 100. In FIG. 3, the X-ray tube 100 in a state of being mounted in the header 3 is illustrated for easy understanding.

The base 1 is made of a suitable metal material, in this example, copper. A filament 5 serving as a cathode and a target 6 serving as an anode are arranged inside the base 1. Although not illustrated in FIG. 3, the filament 5 may be surrounded by a convergence electrode. An electron beam 7 made up of thermoelectrons emitted from the filament 5 collides against the target 6 serving as the anode to generate an X-ray 8 in a specific direction. A window 9 is formed in a side surface of the base 1. The window 9 is made of a material that transmits the X-ray, such as beryllium or Lindemann glass. The X-ray 8 is extracted to the outside through the window 9, and is used for various purposes.

The filament 5 is electrically connected to an external transformer through intermediation of electrodes 10 passing through the housing 2. The filament 5 is supplied with electrons and is heated with Joule heat. Specifically, the filament 5 and the electrodes 10 form an electron-beam emitting unit.

A cooling structure assembly 11 is provided on a side opposite to a surface of the target 6, against which the electron beam collides. The cooling structure assembly 11 receives a cooling fluid pressurized by an external pump (not shown) from a cooling-fluid supply pipe 12 provided in the header 3. After the cooling fluid cools the target 6, the cooling structure assembly 11 discharges the cooling fluid through a cooling-fluid discharge pipe 13 provided in the header 3. The heated cooling fluid is preferably cooled by, for example, a radiator (not shown), and is circulated again to the cooling-fluid supply pipe 12. In this example, the cooling structure assembly 11 includes members such as the header 3 and a solid heat diffusion member 14, described later. Thus, when the X-ray tube 100 is mounted in an apparatus that uses an X-ray, the cooling structure assembly 11 is completed. In place of the structure described above, the cooling structure assembly 11 may be completed in the X-ray tube 100 alone. In this case, the header 3 is used as a mere attachment for mounting the X-ray tube 100 in the apparatus.

A basic structure of the X-ray tube 100, which is illustrated in FIG. 3, is an example of a representative sealed X-ray tube made of a ceramic. The present disclosure does not preclude employment of another publicly-known or alternative structure of the X-ray tube 100, for example, a sealed X-ray tube made of glass or an open X-ray tube.

Figure 4:
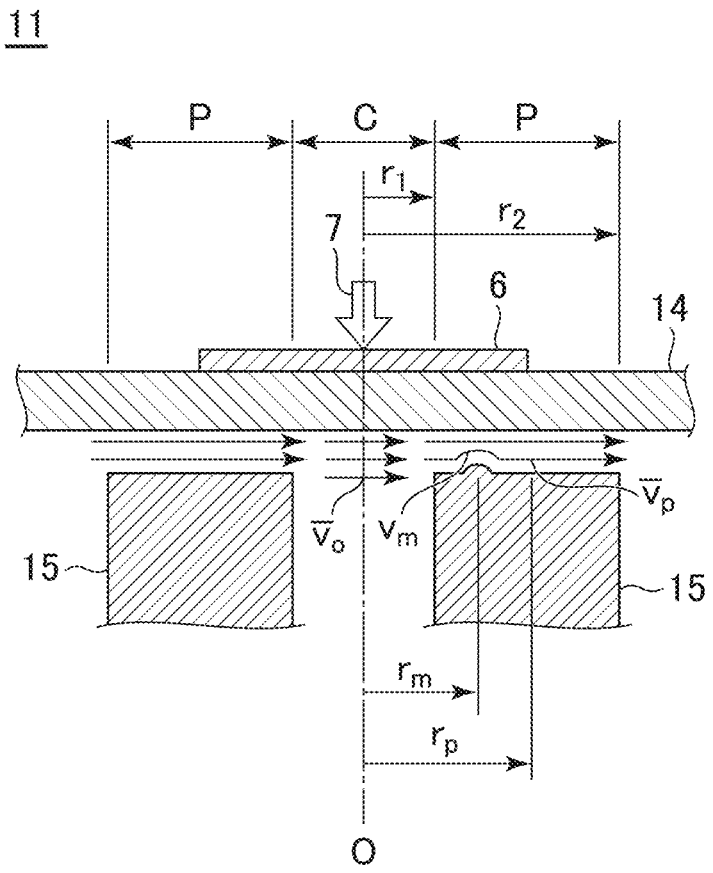
FIG. 4 is a schematic enlarged sectional view for illustrating a concept of a cooling structure assembly of the X-ray tube according to the present invention.

FIG. 4 is a schematic enlarged sectional view for illustrating a concept of the cooling structure assembly 11 of the X-ray tube 100 according to the present invention. The surface (upper surface of FIG. 4) of the target 6, against which the electron beam 7 collides, is referred to as "first surface", and a surface (lower surface of FIG. 4) on the side opposite to the first surface is referred to as "second surface". The solid heat diffusion member 14 is fixed to the second surface of the target 6.

The solid heat diffusion member 14 herein corresponds to a member or a structure which is to be mounted on the second surface of the target 6 for the purpose of quickly diffusing and cooling heat generated in the target 6. In the example of the X-ray tube 100 illustrated in FIG. 3, the solid heat diffusion member 14 and the base 1 are formed as separate members. When mounted on the base 1, the solid heat diffusion member 14 functions as a part of the base 1. However, the solid heat diffusion member 14 and the base 1 may be formed as an integrated member. In this case, the base 1 is formed to have a structure to function as the solid heat diffusion member 14.

The solid heat diffusion member 14 and the target 6 are fixed so as to achieve quick heat transfer. As an example of a fixing method, brazing using a metal foil is given. Further, the solid heat diffusion member 14 and the target 6 may be fixed in such a manner as to be in direct contact with each other or through intermediation of a suitable layer having a large thermal conductivity, for example, a diamond thin film therebetween. The solid heat diffusion member 14 is made of a material having a large thermal conductivity, specifically, a material having excellent solid thermal diffusivity. As an example of such a material, copper is given.

Figure 1:
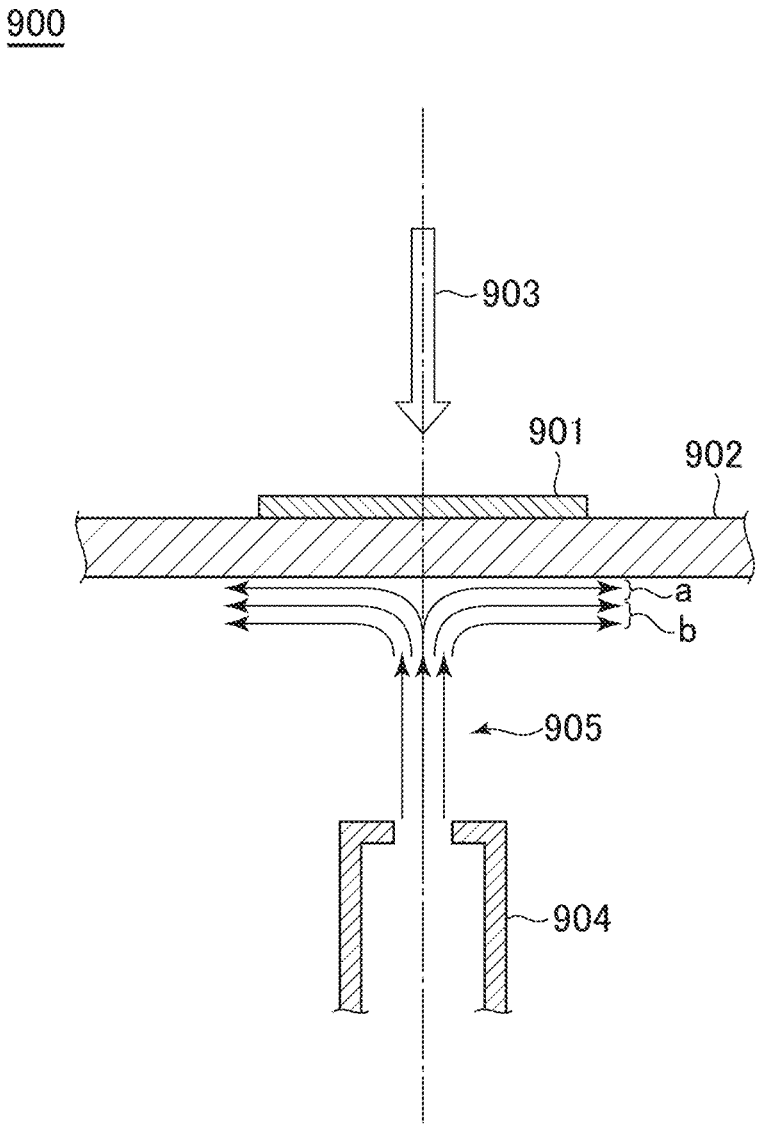
FIG. 1 is a schematic sectional view for illustrating a typical cooling structure assembly for a target.
Figure 2:
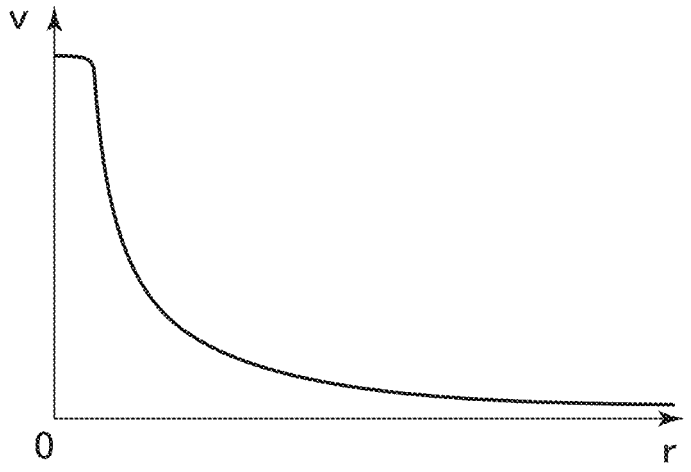
FIG. 2 is a typical example of a graph for showing a flow velocity of a cooling fluid with respect to a distance from a heat generation center in the typical cooling structure assembly for a target.

The solid heat diffusion member 14 serves as a base seat configured to support the target 6. In this regard, the solid heat diffusion member 14 and the support base 902 illustrated in FIG. 1 have the same function. In addition, the solid heat diffusion member 14 has a function of allowing the heat generated in the target 6 to be quickly diffused therein. The heat is diffused in the solid heat diffusion member 14 at high speed. Thus, the heat generated in the target 6 is quickly conducted to a back surface of the solid heat diffusion member 14, specifically, a surface of the solid heat diffusion member 14 on the side opposite to the target 6.

A flow-path forming member 15 is arranged on the back surface side of the solid heat diffusion member 14. As a result, a flow path, through which the cooling fluid passes, is defined between the solid heat diffusion member 14 and the flow-path forming member 15. In FIG. 4, the back surface of the solid heat diffusion member 14 and an upper surface of the flow-path forming member 15, which define the flow path, are schematically illustrated as surfaces substantially parallel to the second surface of the target 6. However, a shape of the flow path is not limited thereto. Embodiments for flow paths having various specific shapes are described later.

A heat generation center of the target 6 is represented by O, and a distance from the heat generation center O in plan view, specifically, when viewed in a direction of emission of the electron beam 7 is represented by r. In this embodiment, the flow-path forming member 15 has the following feature. Specifically, the flow-path forming member 15 defines a film flow path having a shape extending along the back surface of the solid heat diffusion member 14 in a peripheral region P with respect to the heat generation center O. In FIG. 4, the film flow path having a shape parallel to the back surface of the solid heat diffusion member 14 is exemplified. However, the shape of the film flow path is not always required to be parallel to the back surface of the solid heat diffusion member 14.

Specifically, as illustrated in FIG. 4, distances $r_1$ and $r_2$ from the heat generation center O, which satisfy $0<r_1<r_2$, are set. A region with the distance r falling within a range of from 0 to $r_1$ is defined as a central region C, and a region with the distance r falling within a range of from $r_1$ to $r_2$ is defined as the peripheral region P. The flow path defined by the flow-path forming member 15 includes a portion corresponding to the film flow path in the peripheral region P. In this case, the film flow path, specifically, the flow path having a film-like shape means that a thickness of the flow path (length in a direction perpendicular to the back surface of the solid heat diffusion member 14) is sufficiently smaller than a width of the flow path (length in a direction that is parallel to the back surface of the solid heat diffusion member 14 and perpendicular to a fluid flow) and a length of the flow path (length in a direction that is parallel to the back surface of the solid heat diffusion member 14 and parallel to the fluid flow).

Qualitatively, the thickness of the film flow path is only required to be set to such a thickness that improves efficiency of heat transfer from the back surface of the solid heat diffusion member 14 to the cooling fluid flowing through the flow path. As described above, the heat transfer is predominantly affected by the turbulent boundary layer. Thus, as a basic idea, the thickness of the film flow path is required to be selected such that formation and development of the turbulent boundary layer along the back surface of the solid heat diffusion member 14 are not hindered and the amount of transport of the cooling fluid that does not contribute to the turbulent boundary layer is reduced. Here, a thickness of a sufficiently developed turbulent boundary layer is represented by 6. The turbulent boundary layer is formed along each of the back surface of the solid heat diffusion member 14 and the upper surface of the flow-path forming member 15. Hence, for a thickness d of the film flow path, a practically small value that satisfies:

$$d>2\delta \qquad \text{[Math. 1]}$$

is only required to be selected.

In practice, the value of δ varies depending on the kind of cooling fluid and conditions at the time of operation, such as flow velocity. Thus, it is difficult to uniquely determine a magnitude of d. When it is assumed that water is used as the cooling fluid in the X-ray tube 100, which is used for a common X-ray analysis apparatus, it is preferred to set d to satisfy 0.1 mm≤d≤10 mm, more preferably, 0.2 mm≤d≤5 mm.

Further, to achieve the thickness d of the film flow path, which is sufficiently smaller than the width and the length of the film flow path, for example, when a smaller one of values of the width and the length of the film flow path is set to 1, the thickness d is only required to be set to satisfy d≤½, more preferably, d≤⅕.

The reason why the above-mentioned design is preferred is as follows. Specifically, the thickness d of the flow path is sufficiently small in the film flow path. Thus, the film flow path has a small flow path sectional area, and the flow velocity of the cooling fluid is high in the film flow path. Thus, the heat is quickly transferred from the back surface of the solid heat diffusion member 14 to the cooling fluid flowing through the flow path. In addition, the amount of transport of the cooling fluid that does not contribute to the cooling is small. Hence, cooling is performed with high efficiency.

Then, an area ratio of the central region C and the peripheral region P is expressed by:

$$\frac{P}{C}=\frac{\pi(r_2^2-r_1^2)}{\pi r_1^2}=\left(\frac{r_2}{r_1}\right)^2-1 \qquad \text{[Math. 2]}$$

Thus, the central region C in which jet impingement may occur can be designed as only a small region. Thus, it is easy to set a value of $r_2/r_1$ to 2 or larger. If the design is determined with $r_2/r_1$ set to 2, the ratio P/C is obtained as 3. Thus, the area of the peripheral region P is three times as large as the central region C. As described above, when the film flow path is defined in the peripheral region P having a larger area, a larger area can be cooled with higher efficiency. As a result, cooling efficiency of the cooling structure assembly 11 is remarkably improved.

The condition described above is expressed with focus on a difference between the flow velocity of the cooling fluid in the central region C and the flow velocity in the peripheral region P. Then, when the flow path sectional area of the flow passing through the heat generation center O is represented by $A_o$, an average flow velocity $\bar{v}_o$ of the cooling fluid at the heat generation center O is defined with a volumetric flow rate Q as:

$$\bar{v}_O=\frac{Q}{A_O} \qquad \text{[Math. 3]}$$

Then, when a flow path sectional area of the flow at a predetermined distance $r_p$ that satisfies $r_1<r_p<r_2$ in the peripheral region P is represented by $A_p$, an average flow velocity $\bar{v}_p$ of the cooling fluid at the distance $r_p$ from the heat generation center O can be defined as:

$$\bar{v}_p=\frac{Q}{A_p} \qquad \text{[Math. 4]}$$

In other words, at the distance $r_p$ from the heat generation center O, $$\bar{v}_o<\bar{v}_p \qquad \text{[Math. 5]}$$

is established. Specifically, the average flow velocity $\bar{v}_p$ of the cooling fluid at the predetermined distance $r_p$ from the heat generation center O is larger than the average flow velocity $\bar{v}_o$ of the cooling fluid at the heat generation center O.

The above-mentioned condition is set so as to increase the amount of heat exchange in the peripheral region P having a larger area. Some designs of the cooling structure assembly 11 allow elimination of the cooling in the central region C. In this case, there is no flow of the cooling fluid at a position of the axis passing through the heat generation center O.

Further, it is preferred that the flow velocity of the cooling fluid be maximized in the peripheral region P. Specifically, it is preferred that the film flow path have such a shape that the cooling fluid flows at a maximum flow rate $v_m$ at a predetermined distance $r_m$ that satisfies $r_1<r_m<r_2$ from the heat generation center O. This means that the film flow path has such a shape that the flow path sectional area for the cooling fluid is minimized at the predetermined distance $r_m$ from the heat generation center O, as schematically illustrated in FIG. 4.

The heat exchange is most efficiently performed at the position at which the cooling fluid flows at the maximum flow velocity $v_m$. Thus, it is preferred that the position at which the cooling fluid flows at the maximum flow velocity $v_m$ be close to the heat generation center O. As an example, the position at which the cooling fluid flows at the maximum flow velocity $v_m$ is set on the side closer to the heat generation center O with respect to an intermediate position on the peripheral region P, which satisfies $r=(r_1+r_2)/2$. However, the position at which the maximum flow velocity $v_m$ is achieved may be suitably set, and designs are not always required to meet the condition described above.

The concept of the suitable cooling structure assembly 11 according to the present invention has been described above. Specifically, with the cooling structure assembly 11, the cooling fluid for cooling the target 6 is caused to flow through the film flow path. In the film flow path, the average flow velocity $\overline{v}_p$ of the cooling fluid in the peripheral region with respect to the heat generation center O is higher than the average flow velocity $\overline{v}_o$ of the cooling fluid at the heat generation center O at which the electron beam 7 collides against the target 6 to generate heat when viewed in a direction of irradiation of the electron beam 7. As a result, the target 6 is efficiently cooled. A specific structure of the cooling structure assembly 11 of the present invention will now be described according to various embodiments.

Figure 5:
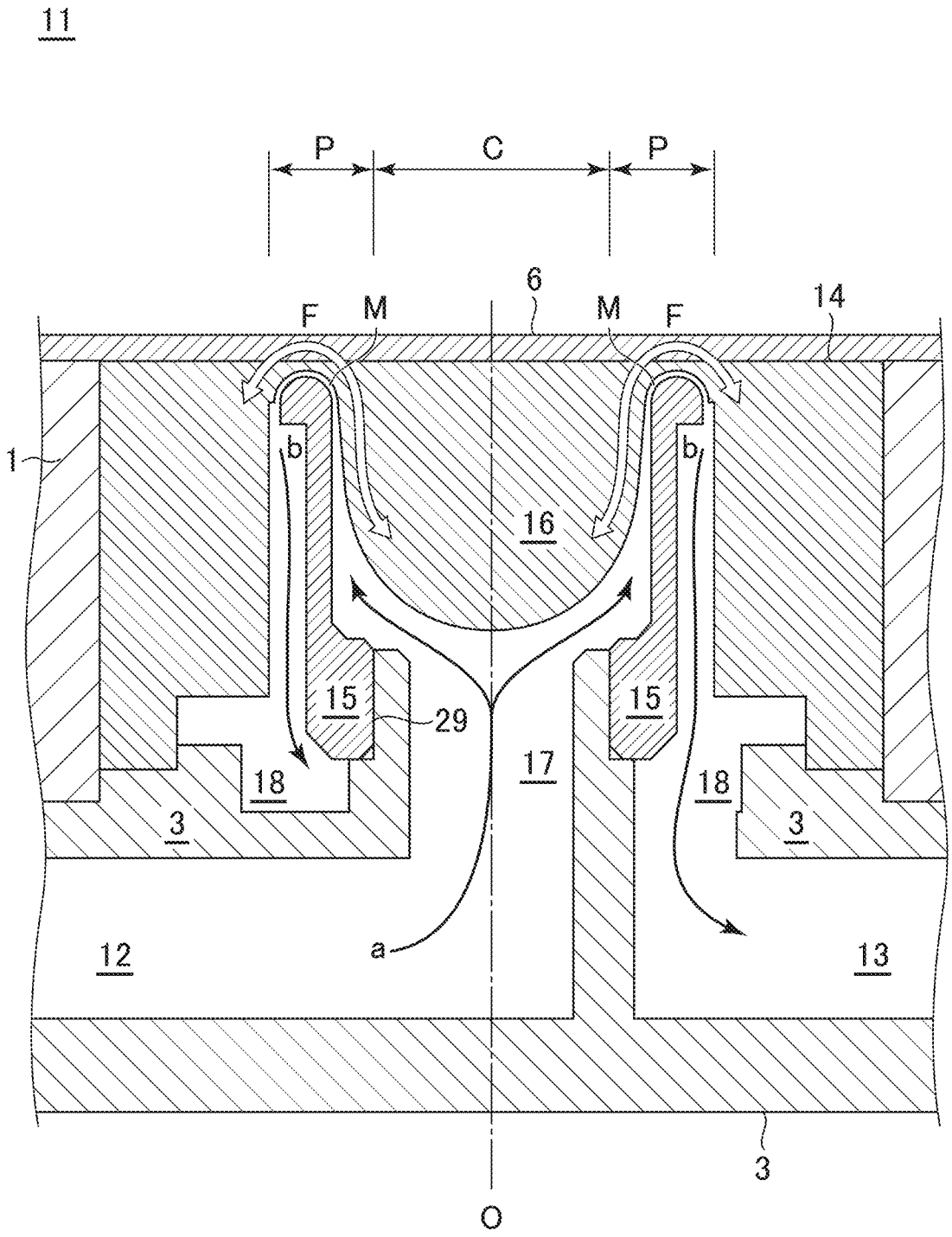
FIG. 5 is a sectional view for illustrating a specific structure of a cooling structure assembly of the X-ray tube according to the first embodiment of the present invention.

FIG. 5 is a sectional view for illustrating a specific structure of the cooling structure assembly 11 of the X-ray tube 100 according to the first embodiment of the present invention, which is illustrated in FIG. 3.

In the cooling structure assembly 11, the target 6 is fixed onto a front surface of the solid heat diffusion member 14. The electron beam 7 is radiated in such a manner that a center axis thereof and a center of the target 6 are aligned. Thus, a position of the center of the target 6, which is indicated by a long dashed short dashed line of FIG. 5, corresponds to the heat generation center O.

The back surface of the solid heat diffusion member 14 is not flat and has a protruding portion 16. As illustrated in FIG. 5, the protruding portion 16 protrudes from the back side of the solid heat diffusion member 14 with the heat generation center O as a center axis of protrusion. In the first embodiment, the protruding portion 16 is axisymmetric (rotationally symmetric) with respect to the axis passing through the heat generation center O serving as a center axis. The protruding portion 16 has a spherical-head shape with a hemispheric distal end. Further, a semi-circular cross section annular surface, which is recessed upward of FIG. 5, is formed around the protruding portion 16. The semi-circular cross section annular surface is smoothly continuous with the protruding portion 16. A wall surface vertically extending downward of FIG. 5 is formed at an outer periphery of the semi-circular cross section annular surface. The wall surface defines a recess formed in the back surface of the solid heat diffusion member 14. In the recess, the protruding portion 16 that protrudes vertically therefrom is formed at a center.

The flow-path forming member 15 is inserted into the recess from below FIG. 5 to reach a position illustrated in FIG. 5 to thereby define the flow path for the cooling fluid between the solid heat diffusion member 14 and the flow-path forming member 15. A material of the flow-path forming member 15 is not particularly limited. In this embodiment, stainless steel is used as the material of the flow-path forming member 15. The flow-path forming member 15 has a substantially cylindrical shape. A shape of a distal end of the flow-path forming member 15 on the target 6 side (specifically, on the upper side of FIG. 5) has a complementary relationship with a shape of the back surface of the solid heat diffusion member 14. In this embodiment, the distal end of the flow-path forming member 15 has a semi-circular cross section annular surface protruding upward, and is designed in such a manner as to define a slight gap between the flow-path forming member 15 and the solid heat diffusion member 14 when the flow-path forming member 15 is properly arranged.

The flow-path forming member 15 has an introduction pipe portion 29 formed on a side opposite to the target 6 (specifically, on the lower side of FIG. 5). The introduction pipe portion 29 is connected to the header 3, and has an opening for introducing the cooling fluid into the flow path. In this embodiment, the introduction pipe portion 29 is a cylindrical portion that is provided coaxially with the axis passing through the heat generation center O, which also serves as the center axis of the protruding portion 16. When an upwardly protruding portion (protruding toward the upper side of FIG. 5) of the header 3 is inserted into the introduction pipe portion 29, an anterior chamber 17 is defined. As a result, the introduction pipe portion 29 and the cooling-fluid supply pipe 12 in the header 3 are liquid-tightly connected, and the flow-path forming member 15 is fixed at a designed position. Thus, in this embodiment, the anterior chamber 17 has a substantially circular columnar shape, and has a center axis that aligns with the axis passing through the heat generation center O. The sectional shape illustrated in FIG. 5 is an example of the above-mentioned shape.

In this embodiment, all the center axes of the protruding portion 16, the introduction pipe portion 29, and the anterior chamber 17 align with the axis passing through the heat generation center O. The center axes of the above-mentioned portions are not required to always align with the axis passing through the heat generation center O, and may align with a geometric center of the protruding portion 16 or the target 6 when viewed from the target 6 side. However, it is considered that, in a large majority of designs, the center axes of the above-mentioned portions align with the axis passing through the heat generation center O. Further, the shape of the introduction pipe portion 29 is not limited to the cylindrical shape, and may be other suitable tubular shapes such as a polygonal tubular shape. The shape of the anterior chamber 17 is not limited to the circular columnar shape, and may be other suitable columnar shapes such as a polygonal columnar shape.

The header 3 is configured to close the recess in the solid heat diffusion member 14 on the side opposite to the target 6. In this manner, the header 3 brings the flow path defined between the solid heat diffusion member 14 and the flow-path forming member 15 into communication with the cooling fluid supply pipe 12 and the cooling fluid discharge pipe 13. In addition, as described above, the flow-path forming member 15 is fixed at the predetermined position with respect to the solid heat diffusion member 14.

The cooling fluid, which has flowed from the cooling-fluid supply pipe 12, flows from the anterior chamber 17 defined in the central region C located below the protruding portion 16 into a space around the protruding portion 16, as indicated by arrows a. Then, in the peripheral region P, the cooling fluid passes through a film flow path F defined between the solid heat diffusion member 14 and the flow-path forming member 15 to turn into a film flow.

Specifically, as described in this embodiment, the heat generated in the target 6 is diffused through the solid heat diffusion member 14 to the protruding portion 16 to thereby increase a coolable surface area. Further, when the flow path is defined along a surface of the protruding portion 16 so as to cause the cooling fluid to flow along the surface of the protruding portion 16, the cooling efficiency is remarkably increased. At the same time, a pressure loss in the flow of the cooling fluid is reduced.

In FIG. 5, a section over which the flow path is defined as the film flow path F is indicated by outlined arrows. The film flow path F has a smaller flow path sectional area than other portions of the flow path. Thus, the flow velocity of the cooling fluid is increased to efficiently receive the heat from the solid heat diffusion member 14 through the heat exchange.

After that, the cooling fluid flows downward along an outer peripheral surface of the flow-path forming member 15 as indicated by arrows b. The cooling fluid then flows into a posterior chamber 18 having a circular tubular shape to be discharged through the cooling fluid discharge pipe 13. Flow path sectional areas of the anterior chamber 17 and the posterior chamber 18 are set large so as to reduce the pressure loss that may be caused by the flow of the cooling fluid. Thus, a flow velocity in the anterior chamber 17 and the posterior chamber 18 is sufficiently smaller than that in the film flow path F. The design described above reduces pressure-boosting performance required for a pump configured to supply a sufficient amount of the cooling fluid to the cooling structure assembly 11.

As is apparent from FIG. 5, the film flow path F of this embodiment allows the flow to isotropically spread from the heat generation center O in plan view. Thus, when a thickness of the flow path is the same, the flow path sectional area is smaller at a position closer to the heat generation center O. Thus, in this embodiment, a position M at which the maximum flow velocity $v_m$ of the cooling fluid is obtained is close to a center of the film flow path F defined by the semi-circular cross section annular surface protruding upward, as illustrated in FIG. 5.

Figure 6:
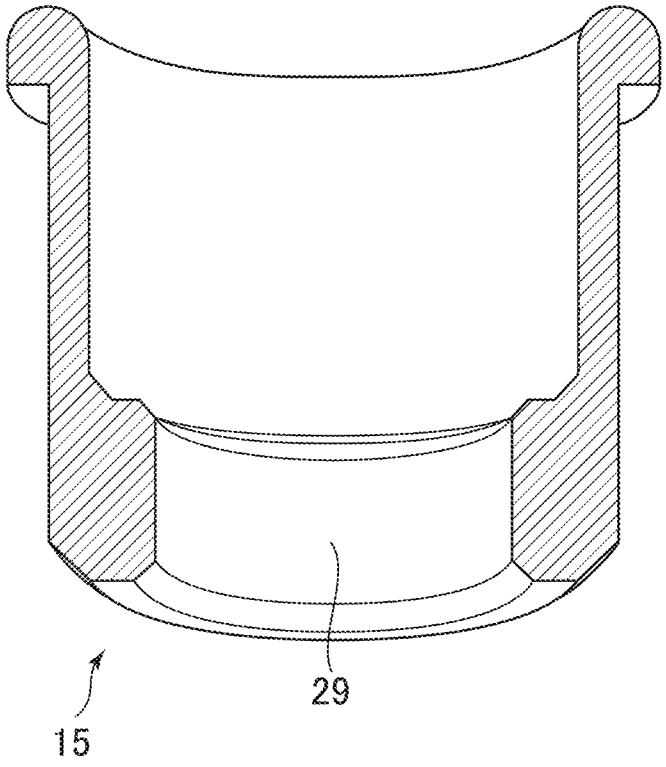
FIG. 6 is a sectional perspective view of a flow-path forming member of the cooling structure assembly included in the X-ray tube according to the first embodiment of the present invention, which is illustrated in FIG. 5.

FIG. 6 is a sectional perspective view of the flow-path forming member 15 of the cooling structure assembly 11 included in the X-ray tube 100 according to the first embodiment of the present invention, which is illustrated in FIG. 5. In FIG. 6, there is illustrated a sectional shape of the flow-path forming member 15, which is taken along a plane passing through the center axis thereof. The sectional shape of the flow-path forming member 15 is also illustrated in FIG. 5. The flow-path forming member 15 has a substantially cylindrical shape as a whole. The semi-circular cross section annular surface of an upper edge of the flow-path forming member 15, which is illustrated in an upper part of FIG. 6, forms a part of the wall surface defining the film flow path. Further, a portion having a large thickness, which is illustrated in a lower part of FIG. 6, corresponds to the introduction pipe portion 29 having a cylindrical shape.

Figure 7:
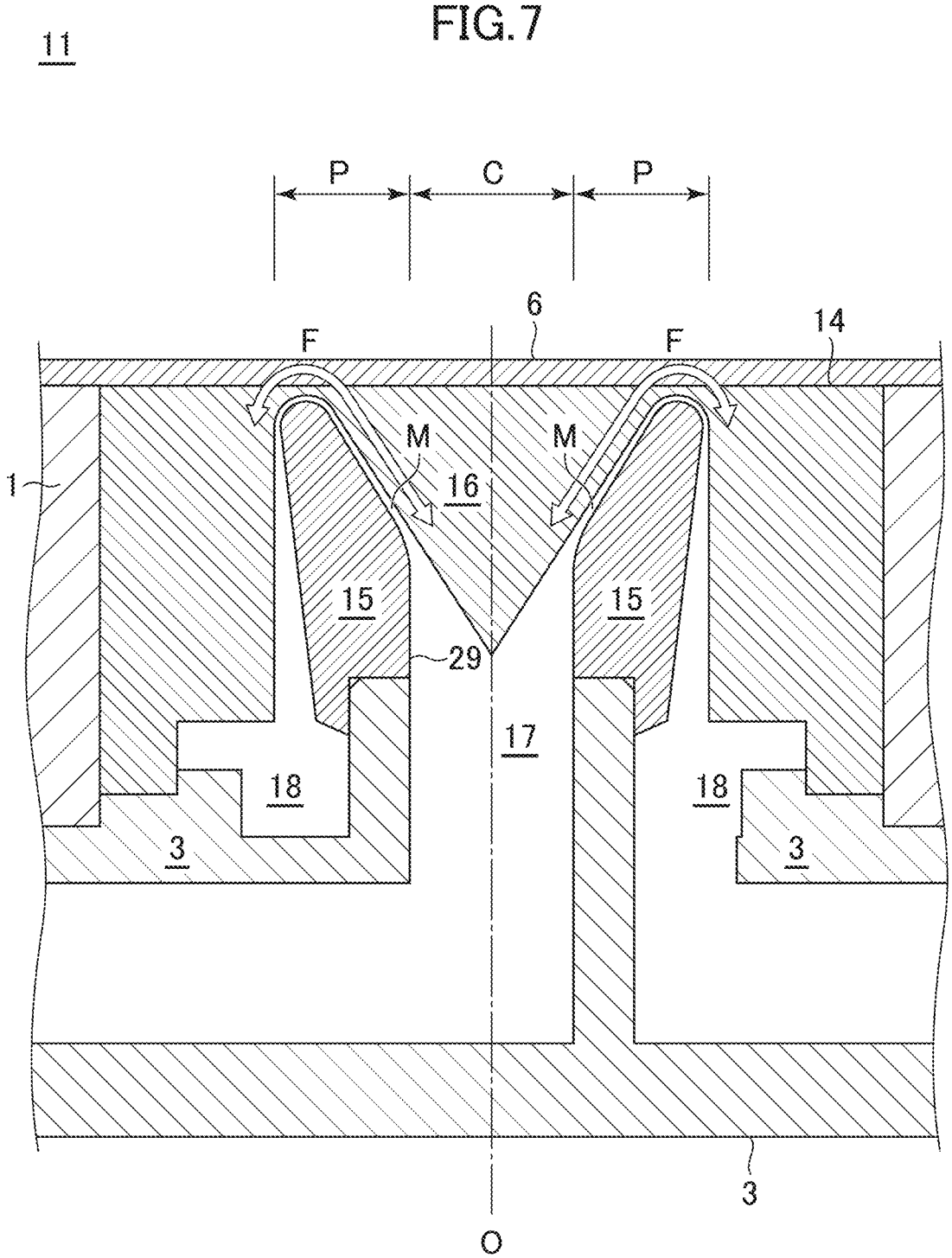
FIG. 7 is a sectional view for illustrating a specific structure of a cooling structure assembly of an X-ray tube according to a second embodiment of the present invention.

FIG. 7 is a sectional view for illustrating a specific structure of the cooling structure assembly 11 of the X-ray tube 100 according to a second embodiment of the present invention. The second embodiment is different from the first embodiment only in a specific shape of the cooling structure assembly 11, and is not otherwise different. Thus, FIG. 3 is referred to as the drawing for illustrating an overall configuration of the X-ray tube 100. Further, equivalent or corresponding members in the first and second embodiments are denoted by the same reference symbols, and overlapping description thereof is omitted.

The protruding portion 16 of the cooling structure assembly 11 according to the second embodiment has a pointed-head shape with the heat generation center O as a center axis. In this case, the protruding portion 16 has a conical shape that protrudes downward with the axis passing through the heat generation center O as an axis of the conical shape. Further, the flow-path forming member 15 has a shape corresponding to the protruding portion 16. Specifically, the flow-path forming member 15 has a downwardly recessed conical surface on an inner periphery side of the peripheral region P, which is complementary for the shape of the protruding portion 16. The flow-path forming member 15 has a semi-circular cross section annular surface protruding upward on an outer periphery side of the peripheral region P. The conical surface and the semi-circular cross section annular surface are smoothly continuous with each other.

The film flow path F is defined along the conical surface and the semi-circular cross section annular surface as illustrated in FIG. 7. The position M at which the maximum flow velocity $v_m$ of the cooling fluid is obtained is located in the vicinity of an inlet of the film flow path F. As can easily be understood from FIG. 7, wall surfaces, which define the flow path including the film flow path F, are designed to extend along a flow line of the cooling fluid so as not to cause separation of the flow from the wall surfaces or an eddy in the flow path including the film flow path F. As described above, a surface shape of the flow-path forming member 15 is formed in such a manner as to extend along the flow line of the cooling fluid. As a result, an energy loss due to turbulence of the flow can be reduced, which contributes to reduction in pressure-boosting performance required for the pump configured to supply a sufficient amount of cooling fluid to the cooling structure assembly 11.

Further, in the second embodiment, the anterior chamber 17 is a space having a circular columnar shape, which is defined by connecting an upwardly protruding portion (protruding toward an upper side of FIG. 7) of the header 3 to the introduction pipe portion 29 of the flow-path forming member 15. A center axis of the introduction pipe portion 29 having the cylindrical shape and a center axis of the anterior chamber 17 align with the center axis of the protruding portion 16. As in the first embodiment described above, the anterior chamber 17 and the posterior chamber 18 are each formed to have a large flow path sectional area so as to reduce the pressure loss that may be caused by the flow of the cooling fluid. The flow velocity in the anterior chamber 17 and the posterior chamber 18 is sufficiently smaller than that in the film flow path F.

Figure 8:
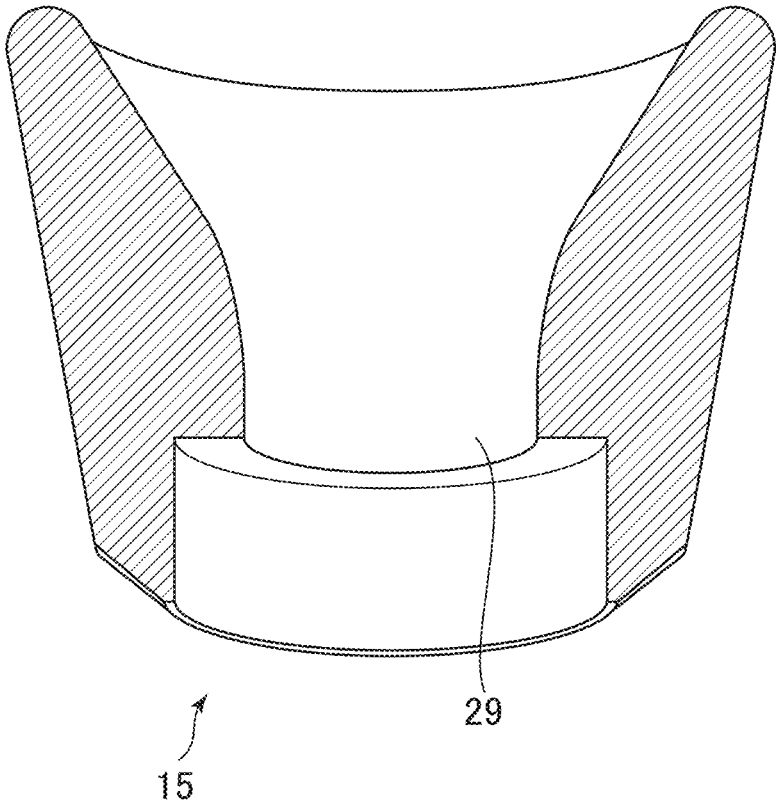
FIG. 8 is a sectional perspective view of a flow-path forming member of the cooling structure assembly included in the X-ray tube according to the second embodiment of the present invention, which is illustrated in FIG. 7.

FIG. 8 is a sectional perspective view of the flow-path forming member 15 of the cooling structure assembly 11 included in the X-ray tube 100 according to the second embodiment of the present invention, which is illustrated in FIG. 7. Also in FIG. 8, there is illustrated a sectional shape of the flow-path forming member 15, which is taken along a plane passing through the center axis thereof. The sectional shape of the flow-path forming member 15 is also illustrated in FIG. 7. Also in the second embodiment, the flow-path forming member 15 has a substantially cylindrical shape as a whole. The conical surface, which extends downward in FIG. 8 continuously from the semi-circular cross section annular surface of an upper edge illustrated in an upper part of FIG. 8, forms a part of the wall surface defining the film flow path. Further, a cylindrical portion extending continuously from the conical surface, which is illustrated in a lower part of FIG. 8, corresponds to the introduction pipe portion 29.

Figure 9:
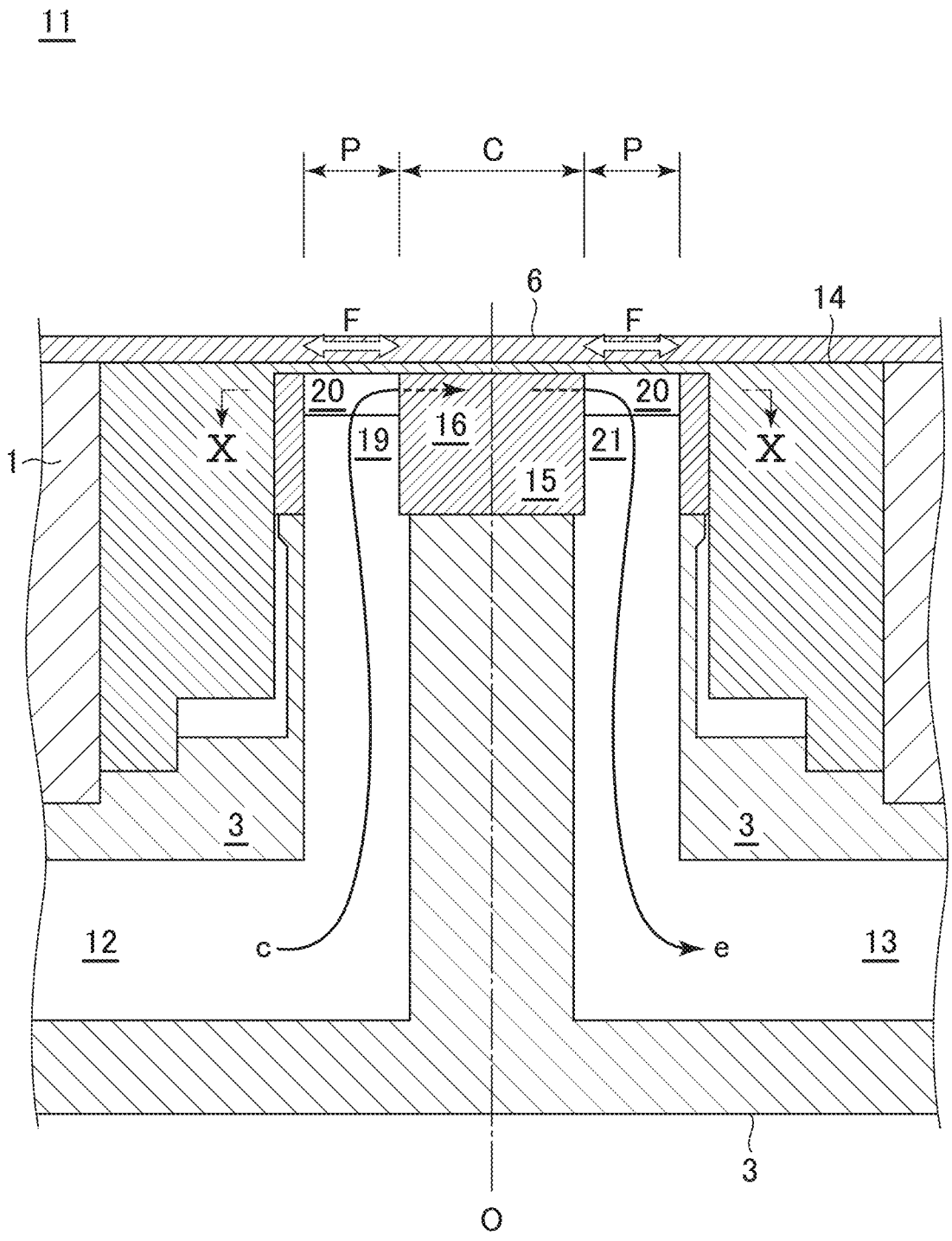
FIG. 9 is a sectional view for illustrating a specific structure of a cooling structure assembly of an X-ray tube according to a third embodiment of the present invention.

FIG. 9 is a sectional view for illustrating a specific structure of the cooling structure assembly 11 of the X-ray tube 100 according to a third embodiment of the present invention. The third embodiment is different from the preceding embodiments only in a specific shape of the cooling structure assembly 11, and is not otherwise different. Thus, FIG. 3 is referred to as the drawing for illustrating an overall configuration of the X-ray tube 100. Further, equivalent or corresponding members in the embodiments are denoted by the same reference symbols, and overlapping description thereof is omitted.

In the cooling structure assembly 11 according to the third embodiment, the solid heat diffusion member 14 has a flat back surface. Thus, the cooling structure assembly 11 has a cylindrical recess with a flat bottom when viewed from the back side. The flow-path forming member 15 having an inflow port 19 and an outflow port 21 is inserted into the recess. When the flow-path forming member 15 is inserted into the recess, a circular annular film flow path 20 in communication with the inflow port 19 and the outflow port 21 is defined. Then, when the header 3 is mounted, the cooling fluid supply pipe 12 and the inflow port 19 are brought into communication with each other and the cooling fluid discharge pipe 13 and the outflow port 21 are brought into communication with each other.

The circular annular film flow path 20 is a flow path having a circular annular shape, which extends in a plane perpendicular to a drawing sheet of FIG. 9. An inlet and an outlet of the circular annular film flow path 20, which are located in a depth direction of FIG. 9, are not normally visible in the sectional view of FIG. 9. However, the inlet and the outlet are illustrated for convenience of the description. The circular annular film flow path 20 itself is defined between the back surface of the solid heat diffusion member 14 and the front surface of the flow-path forming member 15. The circular annular film flow path 20 has a flat rectangular sectional shape in a thickness direction of the flow, as can be seen in FIG. 9. A section of the cooling structure assembly 11, in which the film flow path F is defined, matches a section in which the circular annular film flow path 20 is defined. The section is indicated by outlined arrows of FIG. 9.

Figure 10:
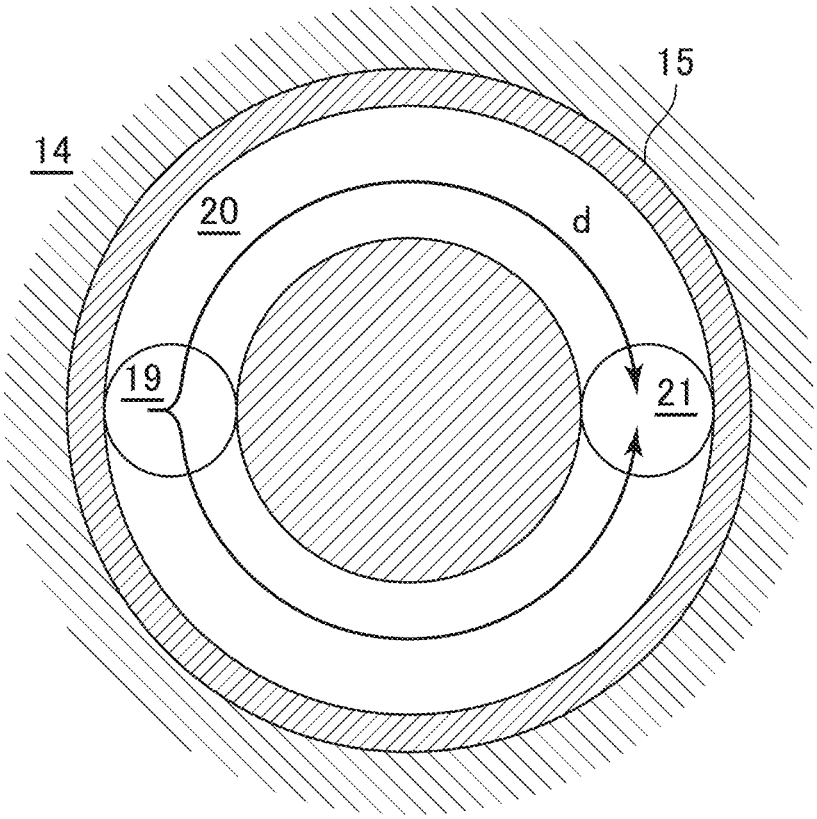
FIG. 10 is a sectional plan view taken along the line X-X of FIG. 9.

FIG. 10 is a sectional plan view taken along the line X-X of FIG. 9. The circular annular film flow path 20 has a circular annular shape in plan view. The inflow port 19 to be brought into communication with the cooling fluid supply pipe 12 is located on one side in a direction perpendicular to the axis passing through the heat generation center O, and the outflow port 21 to be brought into communication with the cooling fluid discharge pipe 13 is located on another side in the direction perpendicular to the axis passing through the heat generation center O. In this example, the inflow port 19 and the outflow port 21, each having a circular sectional shape in plan view, are illustrated in FIG. 10. However, the inflow port 19 and the outflow port 21 are not always required to have a circular sectional shape in plan view, and may have other sectional shapes.

Thus, the cooling fluid flowing from the cooling fluid supply pipe 12 illustrated in FIG. 9 flows toward the target 6 as indicated by an arrow c to flow into the inflow port 19. The cooling fluid flowing through the inflow port 19 is split into two flows, specifically, to an upper side and a lower side of FIG. 10, as indicated by arrows d. The two flows of the cooling fluid move in a circumferential direction in the circular annular film flow path 20 to join together at the outflow port 21. Then, the joined flow of the cooling fluid flows out from the outflow port 21. The cooling fluid, which has flowed out of the circular annular film flow path 20, flows from the outflow port 21 in a direction away from the target 6 as indicated by an arrow e of FIG. 9, and then flows out through the cooling fluid discharge pipe 13.

Figure 11:
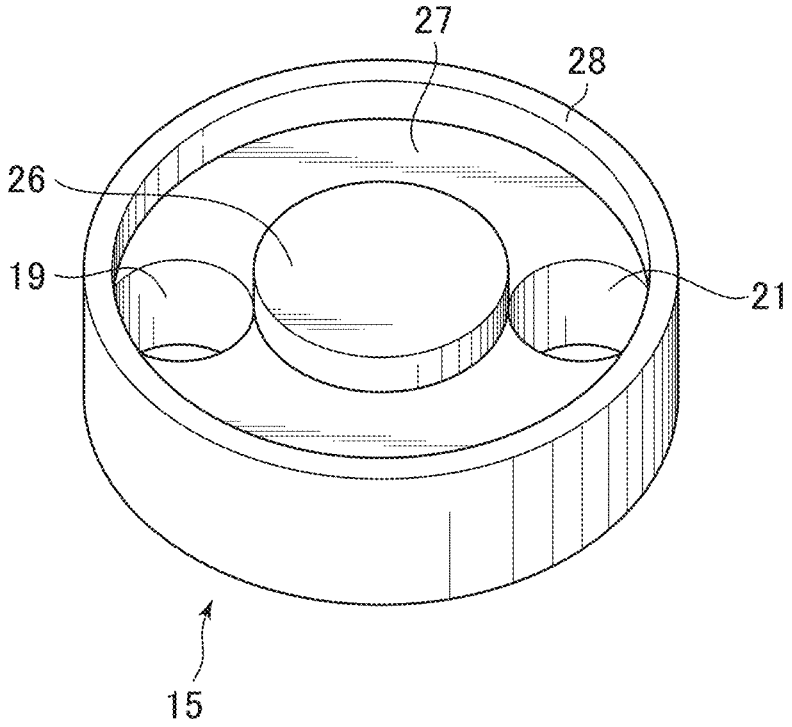
FIG. 11 is a top perspective view of a flow-path forming member of the cooling structure assembly of the X-ray tube according to the third embodiment of the present invention, which is illustrated in FIG. 9 and FIG. 10.

FIG. 11 is a top perspective view of the flow-path forming member 15 of the cooling structure assembly 11 included in the X-ray tube 100 according to the third embodiment of the present invention, which is illustrated in FIG. 9 and FIG. 10. As illustrated in FIG. 11, a column-head portion 26 corresponding to a columnar protruding portion is formed on a central portion of the upper surface of the flow-path forming member 15. A circular annular recessed portion 27, which is a circular annular recess having a rectangular cross section, is formed around the column-head portion 26. The inflow port 19 and the outflow port 21 are formed on the sides opposite to each other with respect to the column-head portion 26 to pass through the circular annular recessed portion 27. A circular annular wall 28 protruding upward in an annular shape is formed on an outer side of the circular annular recessed portion 27.

A height of the column-head portion 26 and a height of the circular annular wall 28 with respect to a bottom surface of the circular annular recessed portion 27 are equal to each other. As illustrated in the sectional view of FIG. 9, when the flow-path forming member 15 is inserted into the recess of the solid heat diffusion member 14, a bottom surface of the solid heat diffusion member 14, and upper surfaces of the column-head portion 26 and the circular annular wall 28 are brought into surface contact with each other. Heat transfer between the solid heat diffusion member 14 and the flow-path forming member 15 is performed through contact surfaces thereof. Thus, the column-head portion 26 functions as the protruding portion 16 that diffuses the heat from the solid heat diffusion member 14 downward. The protruding portion 16 extends downward along the axis passing through the heat generation center O, as illustrated in FIG. 9. When the cooling fluid flows through the circular annular film flow path 20 along an outer peripheral surface of the protruding portion 16, smooth heat exchange is achieved.

In the third embodiment, as is apparent from FIG. 9 to FIG. 11, the flow path does not pass through a position of the heat generation center O, and there is no flow of the cooling fluid at the position of the heat generation center O. Thus, heat generated in the target 6 is exchanged with the cooling fluid only in the peripheral region P. Further, the inflow port 19 and the outflow port 21 are each designed to have a sufficiently large sectional area. In this manner, the flow velocity of the cooling fluid at the inflow port 19 and the outflow port 21 is intended to be reduced to decrease the pressure loss that may be caused by the flow of the cooling fluid.

Further, the maximum flow velocity $v_m$ of the cooling fluid is obtained in the vicinity of a center of the cross section of the circular annular film flow path 20, and is substantially constant along the circumferential direction.

Figure 12:
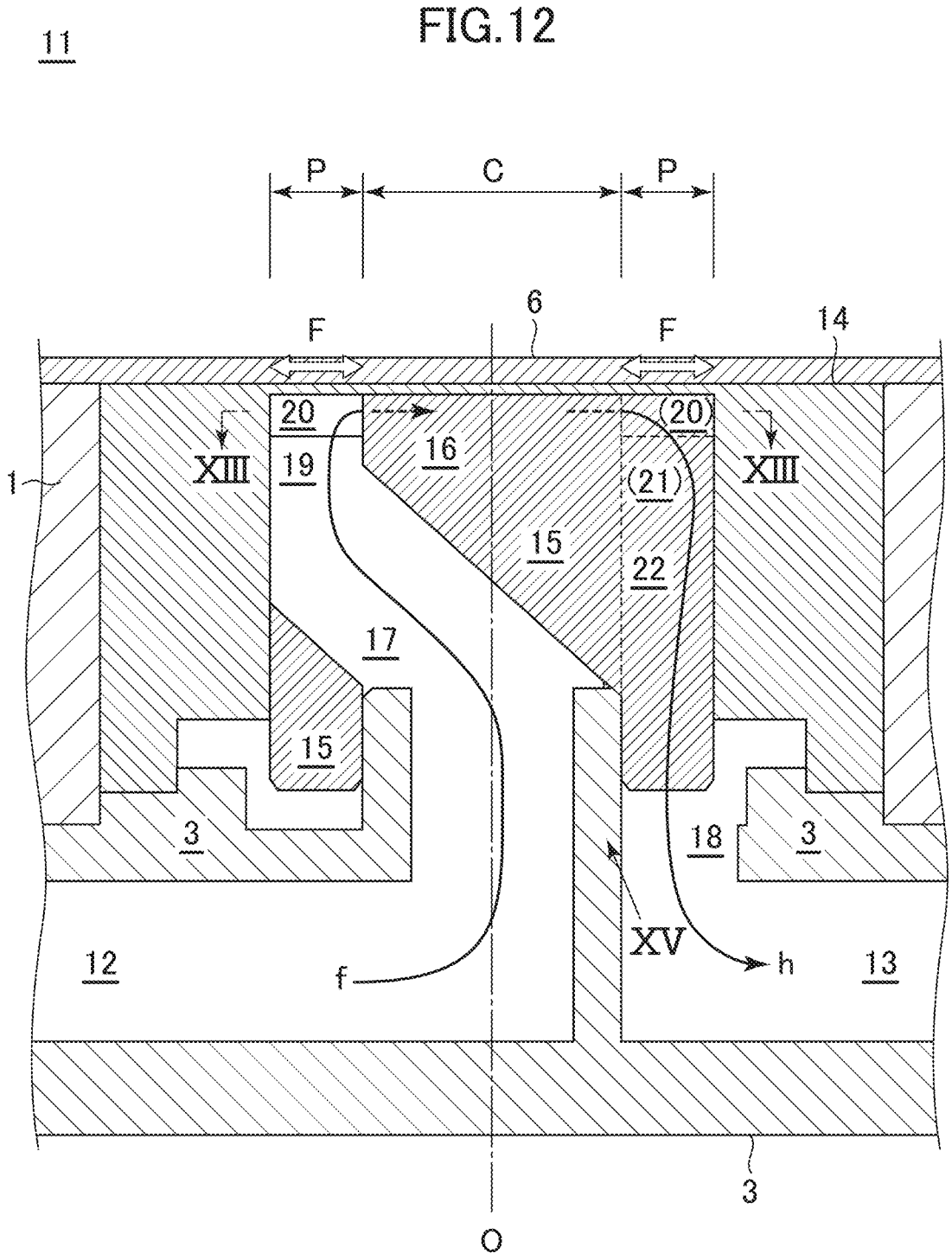
FIG. 12 is a sectional view for illustrating a specific structure of a cooling structure assembly of an X-ray tube according to a fourth embodiment of the present invention.

FIG. 12 is a sectional view for illustrating a specific structure of the cooling structure assembly 11 of the X-ray tube 100 according to a fourth embodiment of the present invention. The fourth embodiment is different from the preceding embodiments only in a specific shape of the cooling structure assembly 11, and is not otherwise different. Thus, FIG. 3 is referred to as the drawing for illustrating an overall configuration of the X-ray tube 100. Further, equivalent or corresponding members in the embodiments are denoted by the same reference symbols, and overlapping description thereof is omitted.

Further, as in the third embodiment, in the cooling structure assembly 11 according to the fourth embodiment, the solid heat diffusion member 14 has a flat back surface, and has a cylindrical recessed shape with a flat bottom when viewed from the back side. The following structure is the same as that in the third embodiment. Specifically, the flow-path forming member 15 is inserted into the recess. When the header 3 is mounted, the cooling fluid supply pipe 12 and the inflow port 19 are brought into communication with each other and the cooling fluid discharge pipe 13 and the outflow ports 21 are brought into communication with each other. The flow-path forming member 15 defines an elliptical annular film flow path 24 in communication with the inflow port 19 and the outflow ports 21.

The elliptical annular film flow path 24 according to the fourth embodiment is a flow path having an elliptical annular shape, which extends in a plane perpendicular to the drawing sheet of FIG. 12. An inlet and an outlet of the elliptical annular film flow path 24, which are located in a depth direction of FIG. 12, are not normally visible in the sectional view of FIG. 12. However, the inlet and the outlet of the elliptical annular film flow path 24 are illustrated in FIG. 12 for convenience of the description. Further, the outflow ports 21 are not normally visible in the sectional view of FIG. 12 either. However, positions of the outflow ports 21 are indicated in FIG. 12. Positions of the outlet and the outflow ports 21 of the elliptical annular film flow path 24 are indicated by broken lines in FIG. 12.

The flow-path forming member 15 has a separation wall 22 formed at a position that overlaps with the outflow ports 21 on the right side of FIG. 12. A shape and a purpose of the separation wall 22 will be described later. The elliptical annular film flow path 24 is defined between the back surface of the solid heat diffusion member 14 and the front surface of the flow-path forming member 15. The elliptical annular film flow path 24 has a flat rectangular sectional shape in a thickness direction of the flow, as can be seen in FIG. 12. A section of the cooling structure assembly 11, in which the film flow path F is defined, matches a section in which the elliptical annular film flow path 24 is defined. The section is indicated by outlined arrows of FIG. 12.

Figure 13:
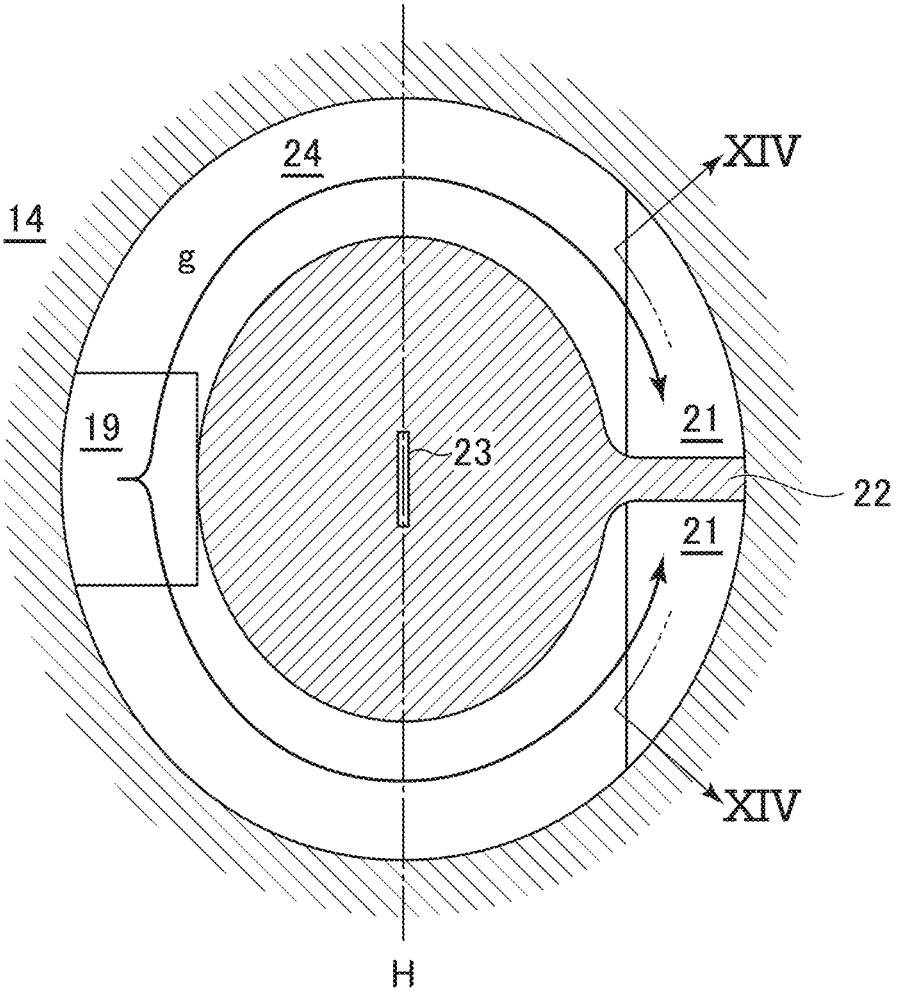
FIG. 13 is a sectional plan view taken along the line XIII-XIII of FIG. 12.

FIG. 13 is a sectional plan view taken along the line XIII-XIII of FIG. 12. The elliptical annular film flow path 24 has an elliptical annular shape with a long axis H in plan view. The inflow port 19 to be brought into communication with the cooling fluid supply pipe 12 is located on one side, and the outflow port 21 to be brought into communication with the cooling fluid discharge pipe 13 is located on another side. The separation wall 22 is formed at the positions of the outflow ports 21. The separation wall 22 is configured to separate two flow paths, into which the flow path has branched at the inflow port 19, at the positions of the outflow ports 21.

As illustrated in FIG. 12, the cooling fluid injected through the cooling fluid supply pipe 12 moves toward the target 6 along the center line passing through the heat generation center O, as indicated by an arrow f. Then, the cooling fluid passes through the anterior chamber 17 extending obliquely upward and flows into the elliptical annular film flow path 24 through the inflow port 19.

As illustrated in FIG. 13, the cooling fluid, which has flowed through the inflow port 19 into the elliptical annular film flow path 24, is split into two flows, specifically, a flow on an upper side and a flow on a lower side of FIG. 13, to flow through the elliptical annular film flow path 24 in a circumferential direction thereof, as indicated by arrows g. Then, the two flows flow out from the outflow ports 21 on the side opposite to the inflow port 19. At this time, the two different flows on the upper side and the lower side of FIG. 13 are separated from each other by the separation wall 22 in such a manner as to flow out into the outflow ports 21 without colliding against each other.

The reason for the formation of the separation wall 22 is as follows. The two flows of the cooling fluid are directed to be substantially opposed to each other at the positions of the outflow ports 21. When the flows are caused to collide against each other, the flows become significantly turbulent to cause an energy loss. The energy loss appears in the form of an increase in pressure loss occurring when the cooling fluid is caused to flow through the cooling structure assembly 11. Thus, when the energy loss due to the collision of the flows occurs, the pump configured to feed the cooling fluid may be required to have correspondingly high capability. Thus, the different flows of the cooling fluid are separated by the separation wall 22 to prevent the collision of the flows.

Figure 14:
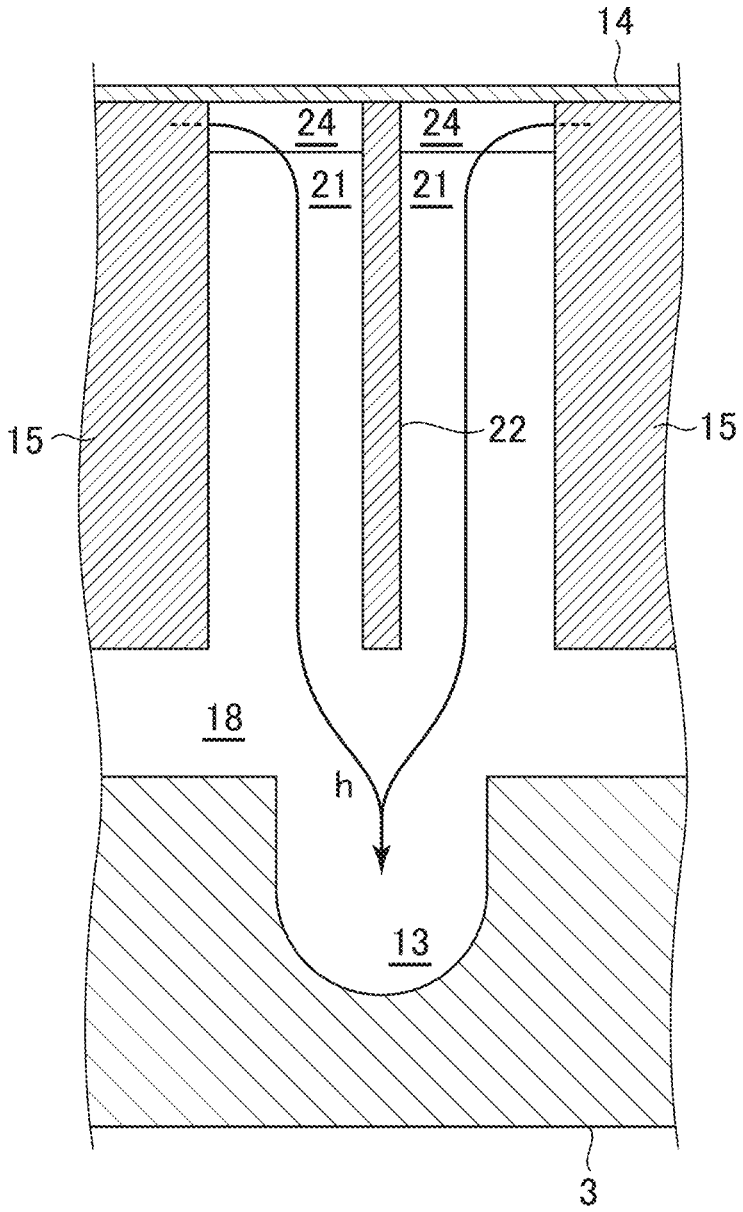
FIG. 14 is a view for illustrating a state in which a flow of a cooling fluid, which is indicated by an arrow h in FIG. 12, is viewed in another direction.

The cooling fluid, which has flowed out through the outflow ports 21, flows in a direction away from the target 6 as indicated by an arrow h of FIG. 12 to be discharged through the cooling fluid discharge pipe 13. FIG. 14 is a sectional view taken along the line XIV-XIV of FIG. 13. The line XIV-XIV of FIG. 13 extends along the circumferential direction of the elliptical annular film flow path 24 to pass through the outflow ports 21 and the separation wall 22.

In FIG. 14, there is illustrated a state in which the flow of the cooling fluid indicated by the arrow h of FIG. 12 is viewed in another direction. The flows of the cooling fluid, which have moved from the elliptical annular film flow path 24 into the outflow ports 21 and have been separated by the separation wall 22, flow down in the direction away from the target 6 along two surfaces of the separation wall 22, respectively. The two flows join together in the posterior chamber 18 into which the separation wall 22 does not extend. After that, the cooling fluid flows into the cooling fluid discharge pipe 13. As is apparent from FIG. 14, when the flows of the cooling fluid join together below the separation wall 22, the two separate flows are directed in substantially the same direction. Thus, the collision of the flows does not occur, and a smooth flow of the cooling fluid is formed.

In the fourth embodiment, the separation wall 22 is effective means to reduce the energy loss due to flow of a cooling medium to reduce the pressure loss. However, the separation wall 22 is not indispensable for cooling of the target 6 with the elliptical annular film flow path 24 in the fourth embodiment. The separation wall 22 may be omitted under a condition that, for example, the pressure loss falls within an allowable range or sufficient cooling performance for the target 6 is obtained. In this case, the flows of the cooling fluid, which are indicated by the arrows g of FIG. 13, may join together at the position of the outflow port 21.

The maximum velocity $v_m$ in the cooling structure assembly 11 according to the fourth embodiment is obtained in the vicinity of a center of a cross section of the elliptical annular film flow path 24, and is substantially constant along the circumferential direction thereof.

Further, in the fourth embodiment, as illustrated in FIG. 13, the elliptical annular film flow path 24 does not have a circular shape, but has an elliptical annular shape with the axis H as a long axis in plan view. The reason for the elliptical annular shape is as follows. Specifically, a shape of a heat generating region of the target 6, against which the electron beam 7 collides to generate heat, is generally not isotropic with respect to the heat generation center O but is longer in a specific direction. More specifically, the heat generating region is a linearly elongated region having a given length. In FIG. 13, there is illustrated a shape of a heat generating region 23. The heat generating region 23 has a linear shape because the filament 5 serving as the cathode configured to emit the electron beam 7 has a linearly elongated shape as illustrated in FIG. 3 and a sectional shape of the electron beam 7 varies depending on the shape of the filament 5.

Thus, the heat generated in the heat generating region 23 having a shape longer in a specific direction propagates not in an isotropic manner but in an anisotropic manner, specifically, substantially linearly in a longitudinal direction of the heat generating region 23. When the heat generating region 23 being longer in a specific direction as described above is assumed, the elliptical annular film flow path 24, which has the elliptical annular shape with the long axis H extending in the longitudinal direction of the heat generating region 23, has an effect of uniformizing a quantity of heat to be exchanged over a total length of the elliptical annular film flow path 24 without unevenness. In this manner, variation in temperature of the solid heat diffusion member 14 along the flow through the elliptical annular film flow path 24 is reduced. Thus, the temperature is prevented from increasing at a specific position, and impairment of the cooling performance due to film boiling occurring in the cooling fluid is prevented.

An eccentricity (or oblateness) of the elliptical annular film flow path 24 is only required to be suitably determined in accordance with, for example, the length of the heat generating region 23 in the longitudinal direction. The eccentricity may be determined by obtaining an optimal shape in an experimental manner or through computer simulation. Further, the shape of the elliptical annular film flow path 24 in plan view is not always required to be elliptical. Other suitable non-isotropic shapes conforming to the shape of the heat generating region 23, such as an oval shape, may be selected.

Figure 15:
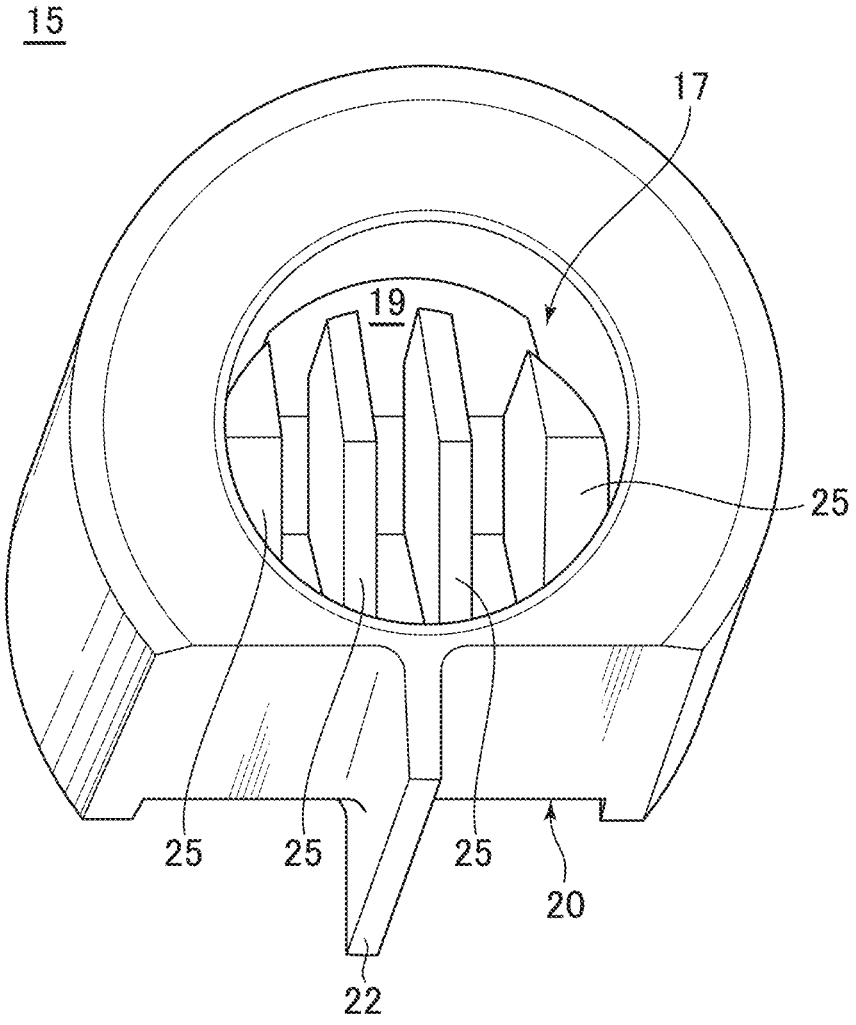
FIG. 15 is a perspective view of a flow-path forming member according to a modification example of the fourth embodiment of the present invention when viewed in an XV direction illustrated in FIG. 12.

FIG. 15 is a perspective view of the flow-path forming member 15 according to a modification example of the fourth embodiment of the present invention when viewed in an XV direction illustrated in FIG. 12. In this modification example, as seen in FIG. 15, a plurality of rectifier fins 25 are provided vertically inside the anterior chamber 17. When the cooling fluid flowing from a near side of FIG. 15 passes through the anterior chamber 17, the flow of the cooling fluid is changed in direction toward a peripheral edge portion of the flow-path forming member 15. Then, the cooling fluid flows into the inflow port 19, which is illustrated on a far side of FIG. 15. With the rectifier fins 25, turbulence of the flow, such as eddies, is less liable to occur while the cooling fluid is flowing in the above-mentioned manner.

The rectifier fins 25 are provided on the flow-path forming member 15 as plate-like members extending in a direction along a desired direction of the flow. The rectifier fins 25 are provided inside the anterior chamber 17 in this modification example. However, positions at which the rectifier fins 25 are arranged are not limited to those inside the anterior chamber 17. The rectifier fins 25 may be provided at any location in the flow path for the cooling fluid. The rectifier fins 25 may be provided, for example, in the elliptical annular film flow path 24, the inflow port 19 and the outflow port 21 for the elliptical annular film flow path 24, and the anterior chamber 17 and the posterior chamber 18, through which the cooling fluid flows before and after passing through the inflow port 19 and the outflow port 21. It is preferred that the rectifier fins 25 be suitably provided at a location where turbulence of the flow is liable to occur, for example, where the direction or the cross section of the flow of the cooling fluid suddenly changes. However, the rectifier fins 25 are not always required to be provided.

When the rectifier fins 25 are provided vertically in the flow path, an area of a flow path surface is increased. Further, the flow path sectional area is reduced for an area of the rectifier fins 25. Thus, a frictional resistance is increased, and a friction loss in pipe flow is at least increased. Meanwhile, loss due to turbulence of the flow is reduced owing to a rectifying effect of the rectifier fins 25. Thus, when the pressure loss reduced owing to the rectifying effect exceeds the friction loss in a pipe, which results from the installation of the rectifier fins 25, it is more beneficial to install the rectifier fins 25. It is preferred that whether or not the rectifier fins 25 are to be installed, the positions at which the rectifier fins 25 are installed, and a shape of each of the rectifier fins 25 be suitably determined in accordance with conditions for the flow of the cooling fluid.

Figure 16:
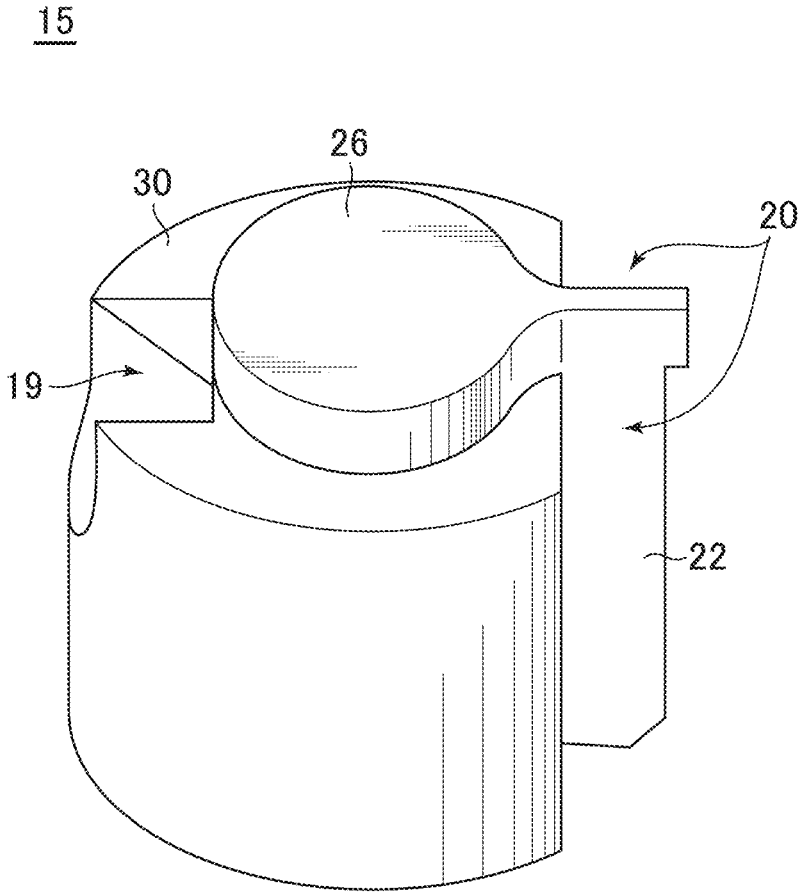
FIG. 16 is a perspective view of the flow-path forming member according to the modification example of the fourth embodiment of the present invention when viewed from an upper surface side that is opposite to the side from which the flow-path forming member is viewed in FIG. 15.

FIG. 16 is a perspective view of the flow-path forming member 15 according to the modification example of the fourth embodiment of the present invention when viewed from an upper surface side that is opposite to the side from which the flow-path forming member 15 is viewed in FIG. 15. As illustrated in FIG. 16, the column-head portion 26, which is a columnar protruding portion, is formed on the central portion of the upper surface of the flow-path forming member 15. An elliptical annular recessed portion 30, which is an elliptical annular recess having a rectangular cross section, is formed around the column-head portion 26. Positions and shapes of the inflow port 19 and the outflow ports 21 and a shape of the separation wall 22 are clearly illustrated in FIG. 16.

Also in this embodiment, as illustrated in the sectional view of FIG. 12, when the flow-path forming member 15 is inserted into the recess of the solid heat diffusion member 14, the bottom surface of the solid heat diffusion member 14 and the column-head portion 26 are brought into surface contact with each other. The heat transfer is performed through the contact surfaces thereof, and thus the column-head portion 26 functions as the protruding portion 16 that allows the heat transferred from the solid heat diffusion member 14 to diffuse downward. The protruding portion 16 also extends downward along the axis passing through the heat generation center O, as illustrated in FIG. 12. When the cooling fluid flows through the elliptical annular film flow path 24 along the outer peripheral surface of the protruding portion 16, smooth heat exchange is achieved.

The cooling performance of the cooling structure assembly 11 according to each of the embodiments described above was evaluated through computer simulation performed under predetermined conditions that are common to the embodiments. As indices to be evaluated for the cooling performance, three indices were selected. Specifically, a pressure loss ΔP (hydrostatic pressure difference between the cooling fluid supply pipe 12 and the cooling fluid discharge pipe 13) given when the cooling fluid passes through the cooling structure assembly 11, a maximum temperature $T_m$ in the cooling structure assembly 11, and a flow path surface maximum temperature $T_{cm}$, which is a maximum temperature of the surfaces that define the flow path for the cooling fluid in the cooling structure assembly 11, were selected. For comparison, a related-art existing cooling structure assembly, which has already been described as the typical cooling structure assembly 900 for the target 901, is described as a jet impingement type cooling structure assembly.

The following conditions were given as the common conditions. Heat generated in the heat generating region 23 was set to 1,000 W. As a size of the heat generating region 23, a width of the heat generating region 23 was set to 0.4 mm, and a length thereof in the longitudinal direction was set to 8 mm. The volumetric flow rate Q of the cooling fluid was set to 4,000 $cm^3$/min. An initial temperature of the cooling fluid was set to 25° C. Water was selected as the cooling fluid. Values of the indices under the above-mentioned conditions are shown in a graph of FIG. 17.

Figure 17:
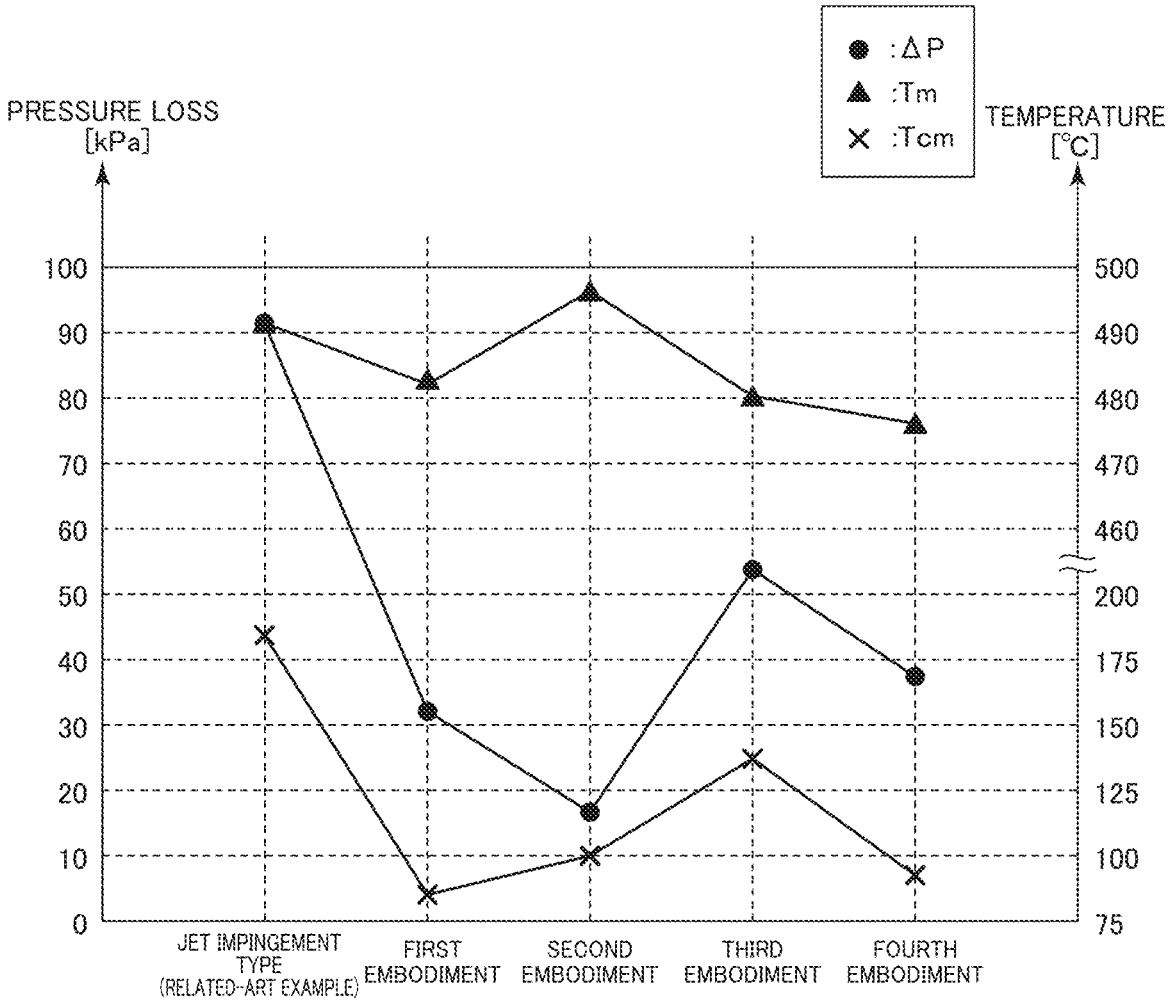
FIG. 17 is a graph for showing cooling performance of each of the cooling structure assemblies according to the embodiments of the present invention and cooling performance of an existing related-art jet impingement type cooling structure assembly in comparison.

In the graph of FIG. 17, a left-hand scale represents the pressure loss ΔP in kPa, and a right-hand scale represents the maximum temperature $T_m$ and the flow path surface maximum temperature $T_{cm}$ in ° C. The maximum temperature $T_m$ and the flow path surface maximum temperature $T_{cm}$ are different in temperature range, and thus distances between adjacent scale marks on the right-hand scale are not all equal.

As is apparent from the graph, the maximum temperature $T_m$ was about 492° C. in the related-art jet impingement type cooling structure assembly. Meanwhile, the maximum temperatures $T_m$ in the cooling structure assemblies 11 according to the first to fourth embodiments remained within a range of from 476° C. to 496° C. The maximum temperatures $T_m$ in the cooling structure assemblies 11 according to the first to fourth embodiments are not significantly different from that of the related-art jet impingement type cooling structure assembly. Thus, it is understood that the cooling structure assemblies of the first to fourth embodiments bear comparison with the jet impingement type cooling structure assembly in the maximum temperature $T_m$. The maximum temperature $T_m$ is obtained at the position immediately below the heat generation center O of the target 6. Thus, it can be said that cooling was achieved without causing melting of the target 6.

The pressure loss ΔP was about 91 kPa in the related-art jet impingement type cooling structure assembly. Meanwhile, the pressure losses ΔP fell within a range of from 17 kPa to 54 kPa in the cooling structure assemblies 11 according to the first to fourth embodiments, and thus were reduced to about 20% to 60%. In particular, the pressure loss was 17 kPa and reduced to about 18% in the cooling structure assembly 11 according to the second embodiment, and was 32 kPa and reduced to 35% in the cooling structure assembly 11 according to the first embodiment. Thus, it is understood that the cooling structure assemblies 11 according to the first and second embodiments are particularly advantageous in the reduction in pressure loss.

The flow path surface maximum temperature $T_{cm}$ was about 183° C. in the related-art jet impingement type cooling structure assembly. Meanwhile, the flow path surface maximum temperatures $T_{cm}$ fell within a range of from 86° C. to 136° C. in the cooling structure assemblies 11 according to the first to fourth embodiments. Accordingly, a reduction by 47° C. to 97° C. was achieved. When the flow path surface maximum temperature $T_{cm}$ largely exceeds a boiling point (100° C. in the case of water at a normal pressure, and a temperature slightly higher than 100° C. in the flow path in the cooling structure assembly 11 because the cooling fluid is pressurized in the flow path) as in the case of the related-art jet impingement type cooling structure assembly, the cooling fluid may cause film boiling at a position having the flow path surface maximum temperature $T_{cm}$. As a result, there is a high risk that the cooling performance may be significantly impaired. However, when the flow path surface maximum temperature $T_{cm}$ is lower than the boiling point or is close to the boiling point, as in the case of the cooling structure assemblies according to the first to fourth embodiments, there is no risk of occurrence of film boiling. Thus, it is considered that stable cooling performance is obtained.

As described above, in the cooling structure assembly 11 according to each of the embodiments of the present invention, significant reductions in the pressure loss ΔP and the flow path surface maximum temperature $T_{cm}$ in the flow path are achieved while sufficient cooling performance for the target 6 is maintained. Thus, efficiency of the cooling performance is improved. Because of the small pressure loss ΔP, a pump with lower performance can be used. The use of such a pump contributes to reductions in size and cost of the pump. Further, because of the low flow path surface maximum temperature $T_{cm}$, even when an output of the electron beam is increased, excellent cooling performance can be continuously maintained. Further, the flow rate of the cooling fluid can easily be increased.

In the cooling structure assembly 11 according to each of the first and second embodiments described above, the protruding portion 16 is formed as a back-surface structure for the solid heat diffusion member 14. In the cooling structure assembly 11 according to each of the third and fourth embodiments described above, the protruding portion 16 is formed as a part of the flow-path forming member 15. However, a member formed to include the protruding portion 16 is not particularly limited. The protruding portion 16 is only required to be formed in such a manner that the heat is diffused from the solid heat diffusion member 14 in a state where the X-ray tube is mounted on the header 3. Thus, the protruding portion 16 is not always required to be formed as a part of the solid heat diffusion member 14 or the flow-path forming member 15. The protruding portion 16 may be formed of another independent member or by combining a plurality of members.

Further, the heat generation center O described above is a position to be conceived as a position of a center of gravity for a heat generation quantity in plan view. However, it is not easy to determine the position of the center of gravity for a heat generation quantity in a precise manner (through, for example, measurement). Further, it is not considered absolutely necessary to determine the position of the center in practical use. Thus, a geometric center of a region irradiated with the electron beam 7 or a geometric center of the target 6 may simply be regarded as the heat generation center O. Further, the center axis of the protruding portion 16 has been described as aligning with the axis passing through the heat generation center O in each of the embodiments. However, the center axis of the protruding portion 16 and the axis passing through the heat generation center O are not required to be precisely aligned each other. The heat generation center O is required to be at least included in a region in which the protruding portion 16 is formed in plan view.

Further, in the first and second embodiments, a suitable spacer may be provided in a part of the film flow path F so as to fix a thickness of the film flow path F. More specifically, the film flow path F having a predetermined thickness may be precisely and easily achieved in the following manner A protrusion having a predetermined thickness is formed on a part of one or both of the surface of the solid heat diffusion member 14 and the surface of the flow-path forming member 15, which serve as the wall surfaces that define the film flow path F. Then, the solid heat diffusion member 14 and the flow-path forming member 15 are assembled in such a manner as to abut against each other to define the film flow path F. Alternatively, a spacer member having a predetermined thickness may be additionally prepared. Then, the solid heat diffusion member 14 and the flow-path forming member 15 are assembled in such a manner as to sandwich the spacer member therebetween. A position and quantity of the spacer are suitably set. It is preferred that spacers be provided at a plurality of positions in the film flow path F.

The film flow path F has been described as being defined between the solid heat diffusion member 14 and the flow-path forming member 15 in each of the embodiments. However, the flow-path forming member 15 may be formed to define the film flow path F by itself. In this case, the flow-path forming member 15 and the solid heat diffusion member 14 are assembled so as to enable heat transfer therebetween. When the flow-path forming member 15 is formed with high accuracy, the film flow path F having high dimensional accuracy can easily be obtained.

In the fourth embodiment, the elliptical annular film flow path 24 has an elliptical annular shape, and the film flow path F and the protruding portion 16 are formed to have elliptical or oval geometric shapes in plan view. The elliptical annular film flow path 24 having an elliptical annular shape may be used in the first to third embodiments, and the film flow path F and the protruding portion 16 may be formed to have elliptical or oval geometric shapes in plan view. Further, the separation wall 22 described in the fourth embodiment may be provided at the position of the outflow port 21 in the third embodiment.

Figure 18A:
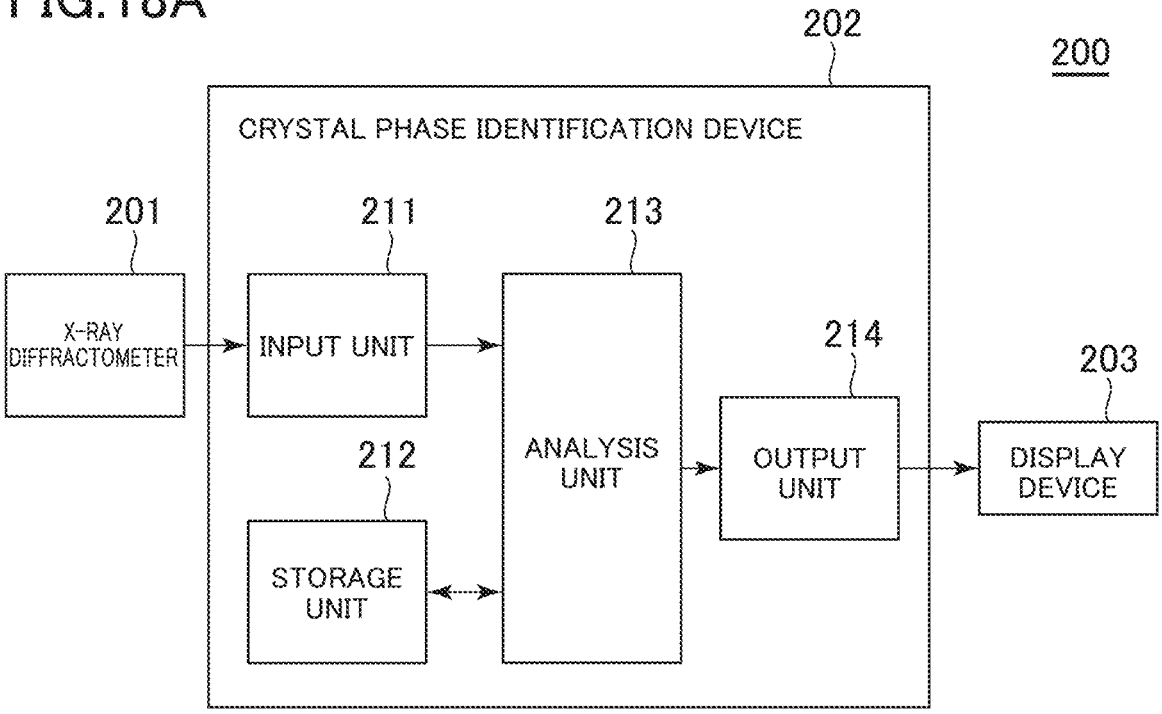
FIG. 18A and FIG. 18B are schematic configuration diagrams of an X-ray analysis apparatus including the X-ray tube according to the present invention.
Figure 18B:
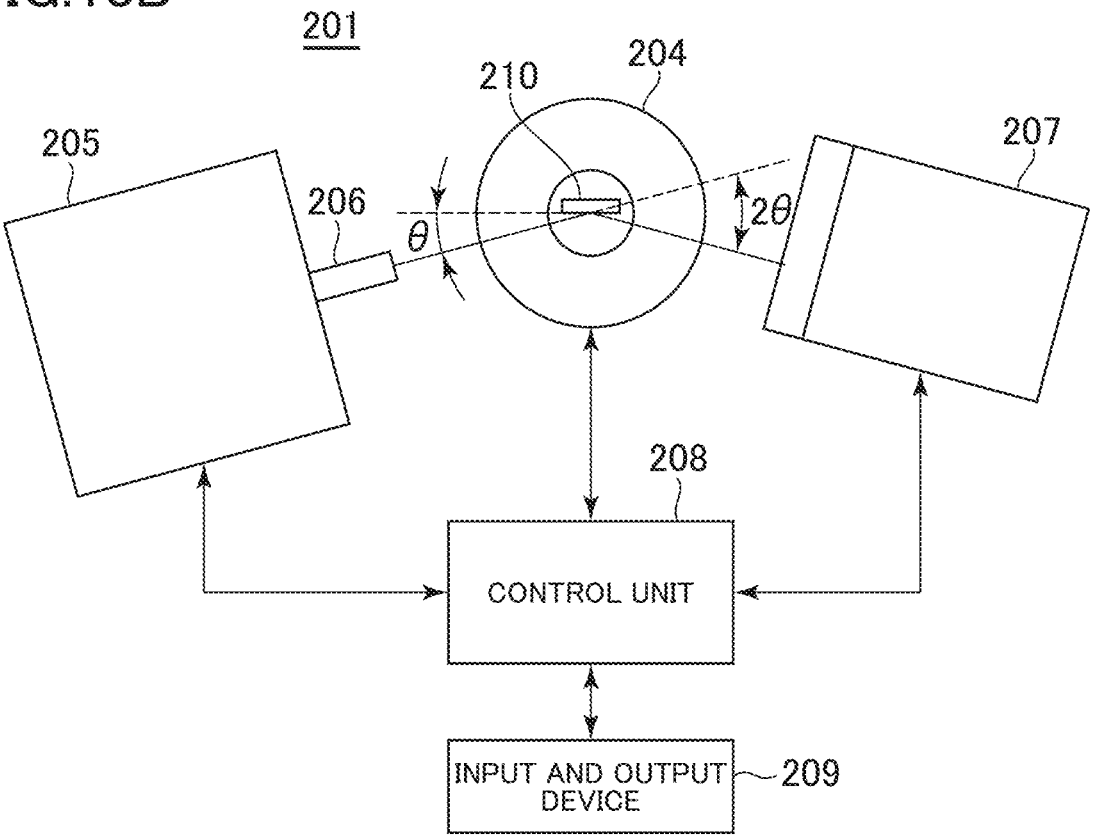

FIG. 18A and FIG. 18B are schematic configuration diagrams of an example of an X-ray analysis apparatus 200 including the X-ray tube 100 according to the present invention. FIG. 18A is a block diagram for illustrating a schematic system configuration of the X-ray analysis apparatus 200, and FIG. 18B is a diagram for illustrating a schematic configuration of an X-ray diffractometer 201.

As illustrated in FIG. 18A, the X-ray analysis apparatus 200 includes the X-ray diffractometer 201, a crystal phase identification device 202, and a display device 203. The display device 203 is formed of, for example, a flat panel display device, and may be formed integrally with the crystal phase identification device 202.

The crystal phase identification device 202 includes an input unit 211, a storage unit 212, an analysis unit 213, and an output unit 214. The crystal phase identification device 202 can be formed of a common computer. In this case, for example, the input unit 211 and the output unit 214 are formed of an input/output interface, the storage unit 212 is formed of, for example, a hard disk or a memory, and the analysis unit 213 is formed of, for example, a CPU. A database is stored in the storage unit 212. In the database, data of peak positions and peak intensity ratios of X-ray diffraction patterns of a plurality of known crystal phases on 2θ-I profiles are registered as data of a distance d between lattice planes versus an intensity ratio I (d-I data). The storage unit 212 may also be, for example, an external hard disk.

The analysis unit 213 stores X-ray diffraction data, which has been input from the X-ray diffractometer 201 through the input unit 211, in the storage unit 212. Then, the analysis unit 213 performs information processing on the X-ray diffraction data stored in the storage unit 212, stores a result of the processing in the storage unit 212, and controls the display device 203 to display the result of processing through the output unit 214.

As illustrated in FIG. 18B, the X-ray diffractometer 201 includes a goniometer 204, an X-ray generator 205, a collimator 206, an X-ray detector 207, a control unit 208, and an input and output device 209. The goniometer 204 is an angle-measuring device, and includes a sample stage provided at a center thereof. The sample stage is configured to mount a sample 210 thereon and rotate. An X-ray generated from the X-ray generator 205 passes through the collimator 206 having a pinhole to be reduced into a thin beam-like ray, and is radiated onto the sample 210. The X-ray detector 207 is configured to detect the X-ray diffracted by the sample 210. When an angle of the X-ray radiated onto the sample 210 is θ with respect to a lattice plane of the sample 210, a diffraction angle is 2θ. The control unit 208 includes, for example, a computer, a sequencer, and a dedicated circuit, and is configured to control the goniometer 204, the X-ray generator 205, and the X-ray detector 207. The input and output device 209 is configured to input, for example, measurement conditions to the control unit 208 and output X-ray diffraction data detected by the X-ray detector 207 to the crystal phase identification device 202. A reflection X-ray diffractometer is illustrated in FIG. 18B. However, a transmission X-ray diffractometer may also be used. Further, the X-ray detector is not limited to a two-dimensional detector. A 0-dimensional detector or a one-dimensional detector may also be used. In this case, the sample or the detector is moved or rotated.

The X-ray tube 100 according to each of the embodiments described above is mounted on the X-ray generator 205 of the X-ray diffractometer 201. When a current is supplied to the electrodes 10 (see FIG. 3), the X-ray is generated. Further, when the cooling fluid is supplied by a fluid pump, which is additionally installed, and is circulated through the X-ray tube 100, the X-ray tube 100 is cooled.

Finally, a method of manufacturing the X-ray tube 100 according to each of the embodiments of the present invention will be described. For the following description of the method of manufacturing the X-ray tube 100, see FIG. 3 and FIG. 5 to FIG. 12, which are referred to above for the embodiments, as needed.

The method of manufacturing the X-ray tube 100 mainly includes three steps, specifically, (1) a manufacturing step for the members, (2) an assembly step for the members, and (3) a vacuuming step.

First, in (1) the manufacturing step for the members, the members are manufactured by publicly-known methods. In the embodiments of the present invention, the cooling structure assembly 11 has particular features in its structure. Thus, the features in the structure of the cooling structure assembly 11 are additionally described, and description of the publicly-known methods of manufacturing the members is omitted.

For the solid heat diffusion member 14, a metal piece having excellent thermal conductivity, such as copper, is processed to have a surface shape serving as the surface for defining the flow path, such as the protruding portion 16. As the processing, cutting using a machining center through computer control may be performed. In this case, a complex flow path shape can be formed as designed. The processing is not limited to the cutting. Various other methods such as forging, casting, and electric-discharge machining, or a combination thereof may be used.

A target piece of, for example, copper or tungsten, which is cut from metal single crystal, is closely fixed onto the front surface of the solid heat diffusion member 14 through brazing using a copper foil or a gold foil. At this time, the target piece is carefully fixed without leaving a gap between the solid heat diffusion member 14 and the target piece so as not to interfere with the heat transfer.

The flow-path forming member 15, the header 3, and the base 1 are also formed through processing suitably using a machine lathe or a machining center. When the flow-path forming member 15 is thermally brought into contact with the solid heat diffusion member 14 and forms the protruding portion 16 as a part of the flow-path forming member 15 as in the examples described in the third and fourth embodiments, it is preferred that the flow-path forming member 15 be made of a metal having excellent thermal conductivity, as in the case of the solid heat diffusion member 14. As an example of such a metal, copper is given. The housing 2 is formed by compacting and sintering a ceramic raw powder. The electrodes 10 and the filament 5 are mounted on the housing 2.

After the members are manufactured as described above, the members are assembled in such a manner as to achieve liquid tightness and air tightness in (2) the assembly step. Various publicly-known methods such as bonding, clamping, screwing, and a method using a screw, may be suitably used to fix the members to each other.

After the completion of the assembly of the X-ray tube 100, an exhaust port (not shown) formed in the base 1 is connected to a vacuum pump in (3) the vacuuming step. Gas inside is sucked out to bring a space inside the base 1 and the housing 2 into a vacuum state. The exhaust port is closed after the vacuuming, and thus the vacuum state of the space inside the base 1 and the housing 2 is maintained even after the vacuum pump is removed.

Through the steps described above, the X-ray tube 100 is manufactured. The thus manufactured X-ray tube 100 is mounted and used not only in the X-ray analysis apparatus 200 but also in various apparatus that use an X-ray.

The embodiments of the present invention described above are given as examples embodying the present invention, and do not limit the technical scope of the present invention to the specific modes. Various modifications may be made to the embodiments by a person skilled in the art depending on the modes of use, and the configurations given in the embodiments may be combined. The technical scope of the present invention given in the description includes such modifications and combinations.

What is claimed is:

1. An X-ray tube, comprising:

an electron-beam emitting unit configured to emit an electron beam;

a target having a first surface against which the electron beam collides and a second surface on a side opposite to the first surface;

a solid heat diffusion member fixed onto the second surface of the target; and a flow-path forming member, which is arranged on a side of the solid heat diffusion member, the side being opposite to the target, and that is configured to define a film flow path in which a cooling fluid forms a film flow, wherein the solid heat diffusion member forms a protruding portion protruding toward the side of which is opposite to the target, a center of the protruding portion overlaps a heat generation center at which the electron beam collides against the target to generate heat when viewed in a direction of emission of the electron beam, and wherein the film flow path has a shape extending along at least a part of a surface of the protruding portion.

2. The X-ray tube according to claim 1, wherein the film flow path has such a shape that an average flow velocity of the cooling fluid at a predetermined distance from the heat generation center is larger than an average flow velocity of the cooling fluid at the heat generation center when viewed in the direction of emission of the electron beam.

3. The X-ray tube according to claim 1, wherein the film flow path has such a shape that a flow path sectional area is minimized at a predetermined distance from the heat generation center when viewed in the direction of emission of the electron beam.

4. The X-ray tube according to claim 1, wherein the protruding portion has one of a spherical-head shape and a pointed-head shape.

5. The X-ray tube according to claim 1, further comprising an introduction pipe portion, which is configured to introduce the cooling fluid into the film flow path, and is arranged such that a center axis of the introduction pipe portion and a center axis of the protruding portion are aligned.

6. The X-ray tube according to claim 1, wherein the film flow path has an inflow port and an outflow port for the cooling fluid, and has a circular annular shape that surrounds the protruding portion.

7. The X-ray tube according to claim 6, wherein the inflow port and the outflow port are located on opposite sides of the film flow path with respect to the protruding portion located therebetween.

8. The X-ray tube according to claim 6, wherein the film flow path has a separation wall configured to separate different flows of the cooling fluid from each other at a position of the outflow port.

9. The X-ray tube according to claim 1, wherein the film flow path has one of an oval shape and an elliptical shape, each having a long axis extending in a longitudinal direction of a heat generating region that generates heat as a result of collision of the electron beam against the target when viewed in the direction of emission of the electron beam.

10. The X-ray tube according to claim 1, wherein the flow-path forming member has rectifier fins arranged along a direction of flow of the cooling fluid.

11. An X-ray analysis apparatus, comprising the X-ray tube of claim 1.

12. The X-ray tube according to claim 1, wherein the target has a planar shape, wherein the protruding portion is solid.

13. A method of cooling a target in an X-ray tube, the method comprising:

defining a film flow path on a rear surface of a target;

cooling the target by causing a cooling fluid for cooling the target to flow through the film flow path in which an average flow velocity of the cooling fluid in a peripheral region around a heat generation center at which an electron beam collides against the target to generate heat is larger than an average flow velocity of the cooling fluid at the heat generation center when viewed in a direction of emission of the electron beam.

* * * * *